US010822208B2

(12) United States Patent
Schoonmaker

(10) Patent No.: US 10,822,208 B2
(45) Date of Patent: Nov. 3, 2020

(54) CRANE 3D WORKSPACE SPATIAL TECHNIQUES FOR CRANE OPERATION IN PROXIMITY OF OBSTACLES

(71) Applicant: Manitowoc Crane Companies, LLC, Manitowoc, WI (US)

(72) Inventor: Stephen J. Schoonmaker, Chambersburg, PA (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 162 days.

(21) Appl. No.: 15/902,111

(22) Filed: Feb. 22, 2018

(65) Prior Publication Data

US 2018/0179029 A1 Jun. 28, 2018

Related U.S. Application Data

(63) Continuation-in-part of application No. 15/850,185, filed on Dec. 21, 2017, which is a continuation of (Continued)

(51) Int. Cl.

*B66C 15/04* (2006.01)
*B66C 23/88* (2006.01)

(Continued)

(52) U.S. Cl.

CPC ..... *B66C 15/045* (2013.01); *B66C 15/04* (2013.01); *B66C 23/88* (2013.01); *B66C 23/90* (2013.01); *B66C 23/905* (2013.01); *B66C 23/94* (2013.01)

(58) Field of Classification Search

CPC ..... B66C 15/045; B66C 15/04; B66C 23/88; B66C 23/905; B66C 13/46; B66C 13/18; B66C 13/48; B66C 23/94

(Continued)

(56) References Cited

U.S. PATENT DOCUMENTS 3,734,302 A * 5/1973 Durand ..... B66C 23/78 212/271
3,760,401 A * 9/1973 Tallon ..... B66C 23/94 340/685

(Continued)

FOREIGN PATENT DOCUMENTS

EP 1868150 A2 12/2007
EP 3037376 A1 6/2016

(Continued)

OTHER PUBLICATIONS

European Search Report issued by ISA/EPO in connection with EP15202088 dated Apr. 29, 2016.

(Continued)

*Primary Examiner* — Richard A Goldman
(74) *Attorney, Agent, or Firm* — Levenfield Pearlstein, LLC

(57) ABSTRACT

A method for controlling a crane component of a tower crane in proximity of obstacles at a worksite by defining a forbidden volume is disclosed. In the method a distance from the crane component to an outer surface of the forbidden volume is determined and a computing device limits movement of the crane component based on the distance from the crane component to the outer surface of the forbidden volume to avoid entering the forbidden volume with the crane component while the crane is in operation. The crane component is one or more of a boom and a hook block.

25 Claims, 20 Drawing Sheets

Related U.S. Application Data application No. 14/974,812, filed on Dec. 18, 2015, now Pat. No. 9,850,109.

(60) Provisional application No. 62/096,041, filed on Dec. 23, 2014.

(51) Int. Cl.
*B66C 23/90* (2006.01)
*B66C 23/94* (2006.01)

(58) Field of Classification Search
USPC ..... 701/50, 36; 414/718
See application file for complete search history.

(56) References Cited

U.S. PATENT DOCUMENTS

| | | | | |
|---|---|---|---|---|
| 3,942,554 | A * | 3/1976 | Werner | B66C 23/18 137/615 |
| 5,089,972 | A * | 2/1992 | Nachman | B66C 13/46 414/139.7 |
| 5,297,019 | A * | 3/1994 | Zuehlke | B66C 13/18 701/50 |
| 5,823,370 | A * | 10/1998 | Ueda | B66C 23/905 212/276 |
| 6,202,013 | B1 | 3/2001 | Anderson | |
| 6,826,452 | B1 | 11/2004 | Holland | |
| 8,346,468 | B2 | 1/2013 | Emanuel | |
| 9,300,954 | B2 | 3/2016 | Tanizumi | |
| 9,302,890 | B1 | 4/2016 | Vogt | |
| 9,611,732 | B2 | 4/2017 | Rempe | |
| 9,850,109 | B2 * | 12/2017 | Schoonmaker | B66C 15/045 |
| 2005/0104736 | A1 | 5/2005 | Gudat | |
| 2008/0004898 | A1 | 1/2008 | Hubler et al. | |
| 2009/0083100 | A1 | 3/2009 | Darby, Jr. et al. | |
| 2010/0264106 | A1 * | 10/2010 | Kawai | B66C 23/86 212/276 |
| 2011/0006025 | A1 * | 1/2011 | Schneider | B66C 13/063 212/273 |
| 2011/0010033 | A1 | 1/2011 | Asahara et al. | |
| 2011/0062104 | A1 * | 3/2011 | Schneider | B66C 15/065 212/276 |
| 2011/0295496 | A1 | 12/2011 | Petrie et al. | |
| 2013/0013251 | A1 * | 1/2013 | Schoonmaker | B66C 13/46 702/152 |
| 2013/0299440 | A1 | 11/2013 | Hermann | |
| 2014/0278076 | A1 * | 9/2014 | Conquest | B66C 13/46 701/468 |
| 2015/0142277 | A1 * | 5/2015 | Eriksson | B66C 13/48 701/50 |
| 2015/0161872 | A1 | 6/2015 | Beaulieu | |
| 2015/0329333 | A1 * | 11/2015 | Fenker | B66C 13/16 212/225 |
| 2016/0176686 | A1 * | 6/2016 | Schoonmaker | B66C 15/045 701/50 |
| 2016/0341041 | A1 | 11/2016 | Puura et al. | |
| 2017/0050824 | A1 * | 2/2017 | Fenger | B66C 1/108 |
| 2018/0057318 | A1 * | 3/2018 | Benton | B66C 13/085 |
| 2018/0141789 | A1 * | 5/2018 | Rudy | B66C 13/18 |
| 2018/0179029 | A1 * | 6/2018 | Schoonmaker | B66C 23/94 |
| 2018/0292223 | A1 * | 10/2018 | Leach | G01C 21/20 |
| 2019/0062130 | A1 * | 2/2019 | Benton | B66C 13/16 |
| 2019/0100382 | A1 * | 4/2019 | Skotschek | B65G 43/00 |
| 2019/0292024 | A1 * | 9/2019 | Ishikawa | B66C 23/88 |
| 2019/0345010 | A1 * | 11/2019 | Shan | B66C 13/22 |

FOREIGN PATENT DOCUMENTS

| | | | |
|---|---|---|---|
| JP | 2002176641 | A | 6/2002 |
| JP | 2010241548 | A | 10/2010 |
| JP | 2010248777 | A | 11/2010 |
| WO | 9220608 | A1 | 11/1992 |
| WO | 2014046213 | A1 | 3/2014 |

OTHER PUBLICATIONS

Extended European Search Report and Written Opinion dated Jul. 25, 2019 issued in connection with corresponding European Patent Application No. 19 158 674.2.

* cited by examiner

CRANE 3D WORKSPACE SPATIAL TECHNIQUES FOR CRANE OPERATION IN PROXIMITY OF OBSTACLES

CROSS-REFERENCE TO RELATED APPLICATION(S)

This application is a continuation-in-part of U.S. patent application Ser. No. 15/850,185 filed on Dec. 21, 2017, which is a continuation of U.S. patent application Ser. No. 14/974,812, filed Dec. 18, 2015, now U.S. Pat. No. 9,850,109, which claims the benefit of provisional U.S. Patent Application Ser. No. 62/096,041, filed Dec. 23, 2014, the disclosures of which are incorporated herein by reference in their entireties.

BACKGROUND

Construction jobsites typically contain a variety of elements such as equipment, power lines, structures, building materials, and personnel. Depending on the phase of a project, there are changing arrangements of these elements while the building project itself progresses toward completion. During any given phase, however, a crane operator is required to take safety precautions so as not to run the boom into obstacles during operation of the crane. To do so, the crane operator often requires another worker on the ground that spots and watches for any impending problems, such as coming too close to an obstacle. This worker may then signal to the crane operator to move away from the obstacle or to shut the crane down. This includes inefficiencies and the need to pay the worker for just monitoring crane function visually.

The ability to alter crane functions with respect to defined areas or forbidden zones within the operational radius of cranes has been made generally available to the construction industry. This capability has evolved as the use of electronics and software for control systems has progressed. This capability is utilized in an operator aid device that can be referred to as a Working Range Limiter or WRL. When a WRL typically defines a forbidden zone it is seen as a map as viewed from above the jobsite.

A traditional WRL is useful for avoiding obstacles when the obstacles occur in the plane of movement, but fails when the geometry becomes more complicated. For example, if a building is marked as a forbidden zone to prevent a boom from impacting the building, a mobile crane will never be able to lift a load to the top of the building because to do so necessarily entails a portion of the crane entering the forbidden zone. If instead, the building is not designated as being in the forbidden zone, the crane could accidentally move into the proximity of the building when swinging the boom.

Likewise, in the case of a tower crane, if a building is marked as a forbidden zone to prevent a boom, trolley or hook from impacting the building, the tower crane may not be able to lift a load to the top of the building. If instead, the building is not designated as being in the forbidden zone, the tower crane could inadvertently be moved into close proximity of the building when swinging the boom or moving the trolley along the boom.

It would be beneficial to develop a system that provides a desired proximity between crane components and obstacles like a traditional WRL system, while allowing the crane to extend into what would traditionally be considered a forbidden zone.

BRIEF DESCRIPTION

A method for controlling a boom of a crane in proximity of obstacles at a worksite is disclosed. In one aspect, the method includes saving, in a memory, coordinate data representing a coordinate system at the worksite; saving, in the memory, obstacle data representing a forbidden volume in the coordinate system; saving, in the memory, boom data representing the location of the boom; and limiting movement of the boom, by a computing device, to avoid the boom entering the forbidden volume, the limiting based on a computed minimum distance between the boom and the forbidden volume using the coordinate data, the obstacle data, and the boom data.

In some embodiments, saving obstacle data includes inputting data representing the forbidden volume. In some embodiments, the boom rotates relative to the crane about a central axis, and saving coordinate data includes saving data representing the central axis.

In some embodiments, saving obstacle data includes using the boom to identify at least two coordinates of the forbidden volume. In some embodiments, the forbidden volume is a rectangular prism and the at least two coordinates include the front, top left corner of the forbidden volume and the front, top right corner of the forbidden volume.

In some embodiments, the crane includes lower works, upper works rotatable relative to the lower works about an axis of rotation, and the boom is disposed on the upper works, and using the boom to identify at least two coordinates of the forbidden volume includes aiming the boom in a first direction at a front face of the forbidden volume and determining a horizontal distance between the face and the axis of rotation to determine a first vector corresponding to the front face of the forbidden volume; aiming the boom in a second direction at a front, top left corner of the forbidden volume and determining a second vector corresponding to the second direction of the boom; intersecting the second vector and a plane to define a first coordinate of the obstacle data; aiming the boom in a third direction at a front, top right corner of the forbidden volume and determining a third vector corresponding to the third direction of the boom; and intersecting the third vector and the plane to define a second coordinate of the obstacle data. In some embodiments, aiming the boom includes at least one of aligning the boom using a video camera attached to the boom and aligning the boom using a laser pointer attached to the boom.

In some embodiments, limiting movement of the boom includes establishing a slowdown threshold distance between the boom and the forbidden volume; and changing a crane function responsive to the computed minimum distance between the boom and the forbidden volume being less than the threshold distance. In some embodiments, changing the crane function includes slowing down the movement of the boom in at least one direction that moves the boom closer to the forbidden volume. In some embodiments, limiting movement of the boom further includes establishing a shutdown threshold distance between the boom and the forbidden volume; and stopping the movement of the boom in response to the computed minimum distance between the boom and the forbidden volume being less than the shutdown threshold distance. In some embodiments, the crane function is selected from a group including telescoping in, telescoping out, booming up, booming down, swinging left, and swinging right.

In some embodiments, the method further includes computing, with the computing device, a maximum swing angle of the boom, a maximum extension of the boom, a maximum boom-up, and a maximum boom-down of the boom.

In some embodiments, determining a horizontal distance between the face and the axis of rotation comprises measuring a distance from the axis of rotation to the face.

In some embodiments, determining a horizontal distance between the face and the axis of rotation comprises placing a hook of the crane proximate the forbidden volume; and using a rated capacity indicator (RCL) hook radius to determine the horizontal distance.

In some embodiments, the data representing the forbidden volume is a building information model, and saving obstacle data comprises aligning the building information model in the coordinate system.

In another aspect a system for controlling a boom of a crane in proximity of obstacles at a worksite is disclosed. The system includes a crane control system configured to control operation of a crane boom; a processor in operable communication with the crane control system; and memory in operable communication with the processor, the memory storing data includes data representing a coordinate system; data representing the crane boom; data representing a forbidden volume; and computer executable instructions for execution by the processor, the computer executable instruction configured to calculate a minimum distance between the crane boom and the forbidden volume based on the data representing the crane boom and the data representing the forbidden volume, and to cause the crane control system to limit movement of the boom based on the calculated minimum distance.

In some embodiments, the computer executable instructions are further configured to determine at least two coordinates of the forbidden volume using the boom. In some embodiments, the system further includes a boom aiming system for aiming the boom at the at least two coordinates of the forbidden volume. In some embodiments, the boom aiming system is a system selected from a group including a laser pointer and a video camera system. In some embodiments, the crane control system limits the motion of the boom in response the calculated minimum distance being less than a threshold distance, and the data further includes a threshold distance value. In some embodiments the crane control system stops the motion of the boom in response to the calculated minimum distance being less than a critical distance, and the data further includes a critical distance value. In some embodiments, the data representing the forbidden volume is a building information model, and the computer executable instructions are further configured to establish the location of the forbidden volume within the coordinate system using the boom.

According to an embodiment, a tower crane includes a mast, a rotating bed coupled to the mast, a boom mounted on the rotating bed, and a hook block connected to the boom. A method for controlling a crane component of a tower crane in proximity of obstacles at a worksite is executable by a computing device having a processor and memory, and includes saving, in the memory, coordinate data representing a coordinate system at the worksite having an origin at a base of an axis of rotation of the rotating bed and fixed relative to the mast, wherein the boom is rotatable on the axis of rotation, saving, in the memory, obstacle data representing a forbidden volume in the coordinate system, saving, in the memory, crane component data representing the location of the crane component, and limiting movement of the crane component, by the computing device, to avoid the crane component entering the forbidden volume, the limiting based on a computed minimum distance between the crane component and the forbidden volume using the coordinate data, the obstacle data, and the crane component data. The crane component is one or more of the boom and the hook block.

According to another embodiment, a system for controlling a crane component of a tower crane in proximity of obstacles at a worksite includes a crane control system configured to control operation of the crane component, a processor in operable communication with the crane control system and memory in operable communication with the processor. The memory stores data including data representing a coordinate system having an origin at a base of an axis of rotation of the rotating bed and fixed relative to the mast, data representing the crane component, data representing a forbidden volume and computer executable instructions for execution by the processor. The computer executable instructions are configured to calculate a minimum distance between the crane component and the forbidden volume based on the data representing the crane component and the data representing the forbidden volume, and to cause the crane control system to control movement of the crane component based on the calculated minimum distance. The crane component is one or more of the boom and the hook block.

DETAILED DESCRIPTION

The present embodiments will now be further described. In the following passages, different aspects of the embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
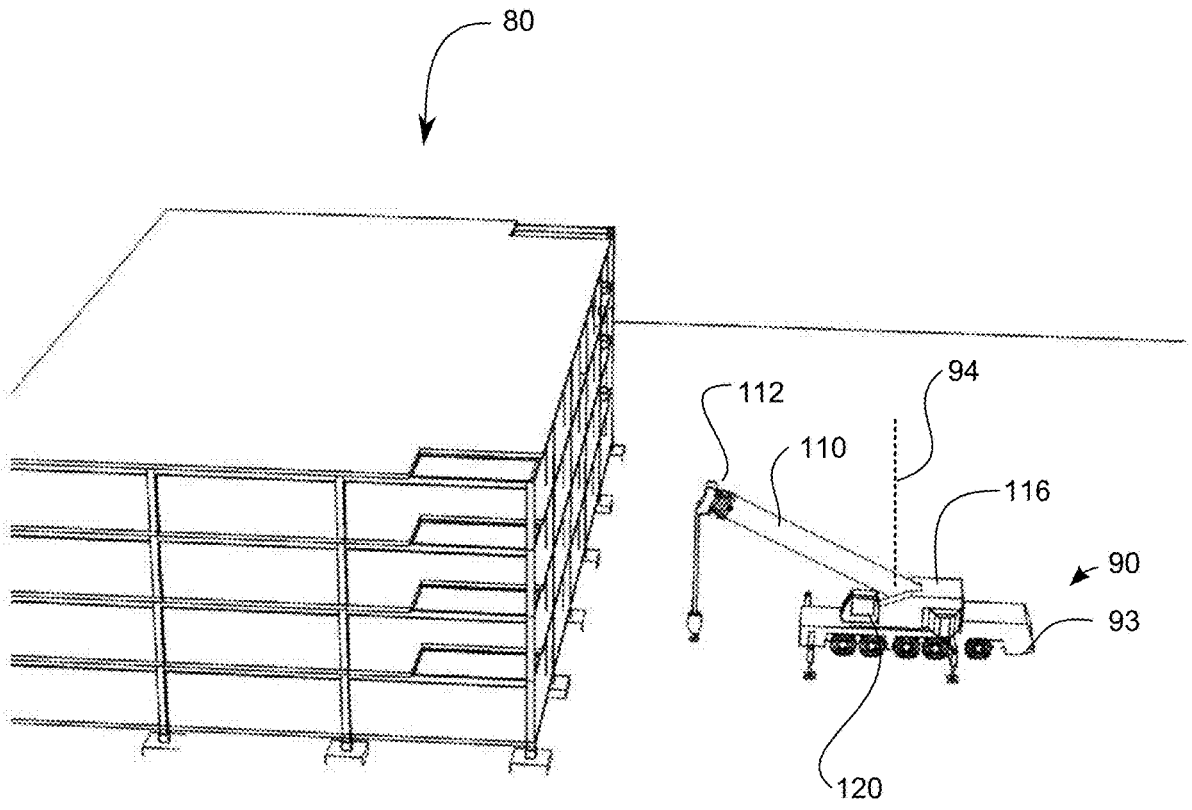
FIG. 1 is a perspective view of a crane and building under construction.

FIG. 1 is a perspective view of a crane 90 and a building 80 under construction. The crane 90 may have a lower works 93 for engagement with the ground, and a cab 120 attached to a rotating bed 116, also referred to as upper works. The rotating bed 116 rotates about an axis 94 of rotation relative to the lower works 93. A boom 110 may also be attached to the rotating bed 116 and be controlled by a computing device, such as a computer system (300 in FIG. 3) located in the cab 120, and by crane controllers controlled by the computing device. The boom 110 may include a telescoping portion 112 at an end of the boom 110 that may be extended (tele-out) or retracted (tele-in) by controls within the cab 120. The use of the cab 120 and the location of the computing device is merely exemplary and a computing device need not be located within the cab 120. For example, the computing device could be integrated in to the lower works of the crane 93.

The computing device and controls may also control the movement of the rotating bed 116, which causes the boom 110 to swing left and swing right. The computing device and controls may also control the boom 110 to move up (boom-up) and move down (boom-down). These six directions (tele-out; tele-in; boom-up; boom-down; swing left; and swing right) may each be represented by a vector, each of which may be processed and tracked using appropriate algorithms as will be explained. Impact with obstacles on a worksite may be avoided by conducting vector analysis and continual monitoring of the orientation of the boom 110.

Figure 2:
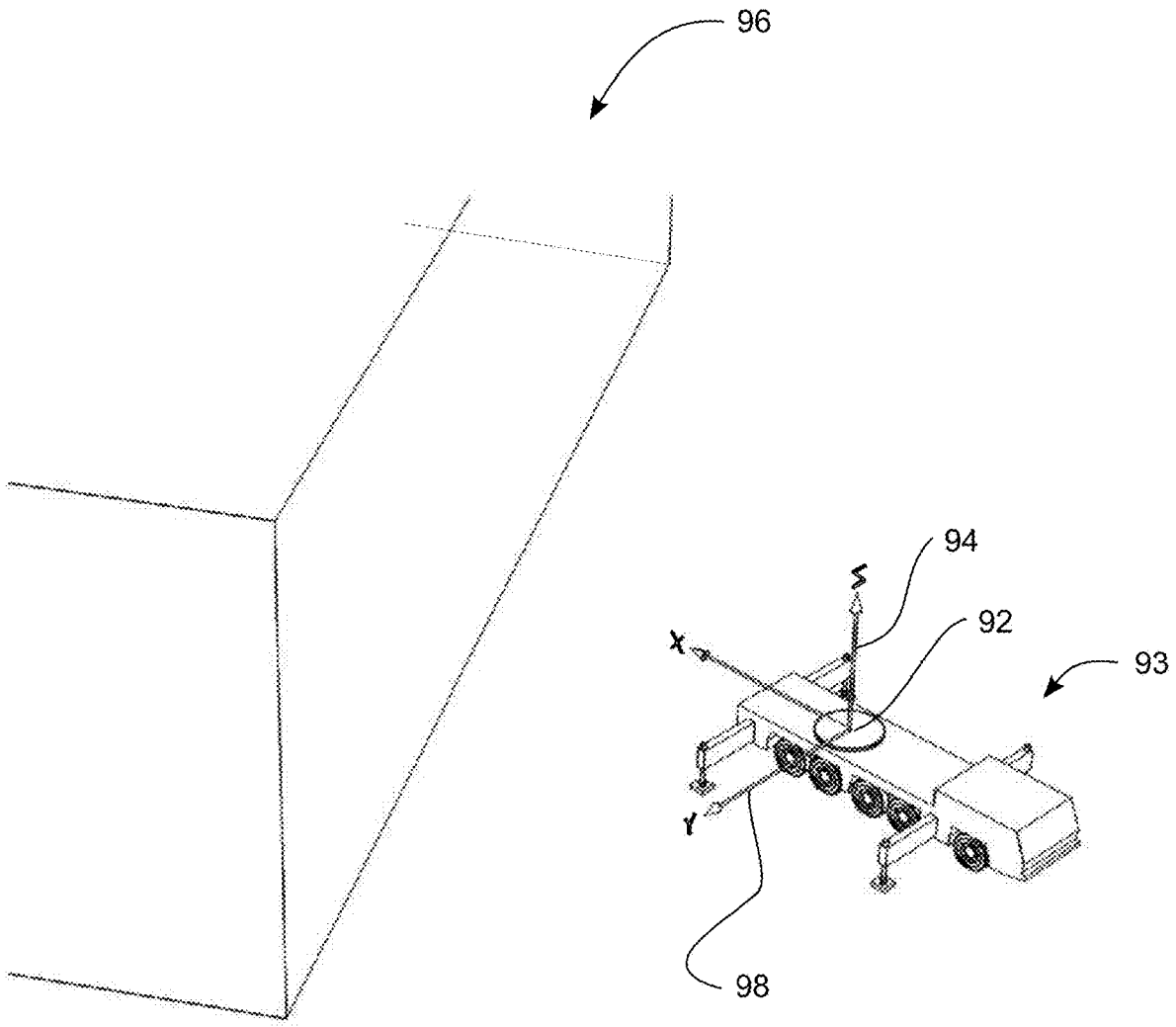
FIG. 2 is a schematic view of a forbidden volume and a coordinate system of a crane.

FIG. 2 is a perspective view of a schematic of the lower works 93 of a telescopic crane 90 and an outline 96 of the building 80 under construction. A coordinate system 98 is shown having an origin 92 at a base of the axis of rotation 94 of a rotating bed. In the embodiments that follow, the coordinate system will be fixed relative to the lower works 93 of the telescopic crane 90. However, in other embodiments the coordinate system could be fixed relative to the rotating bed such that the X axis would remain constant along the telescoping boom. Other coordinate systems are possible and could be based on any origin within the construction zone.

Figure 3:
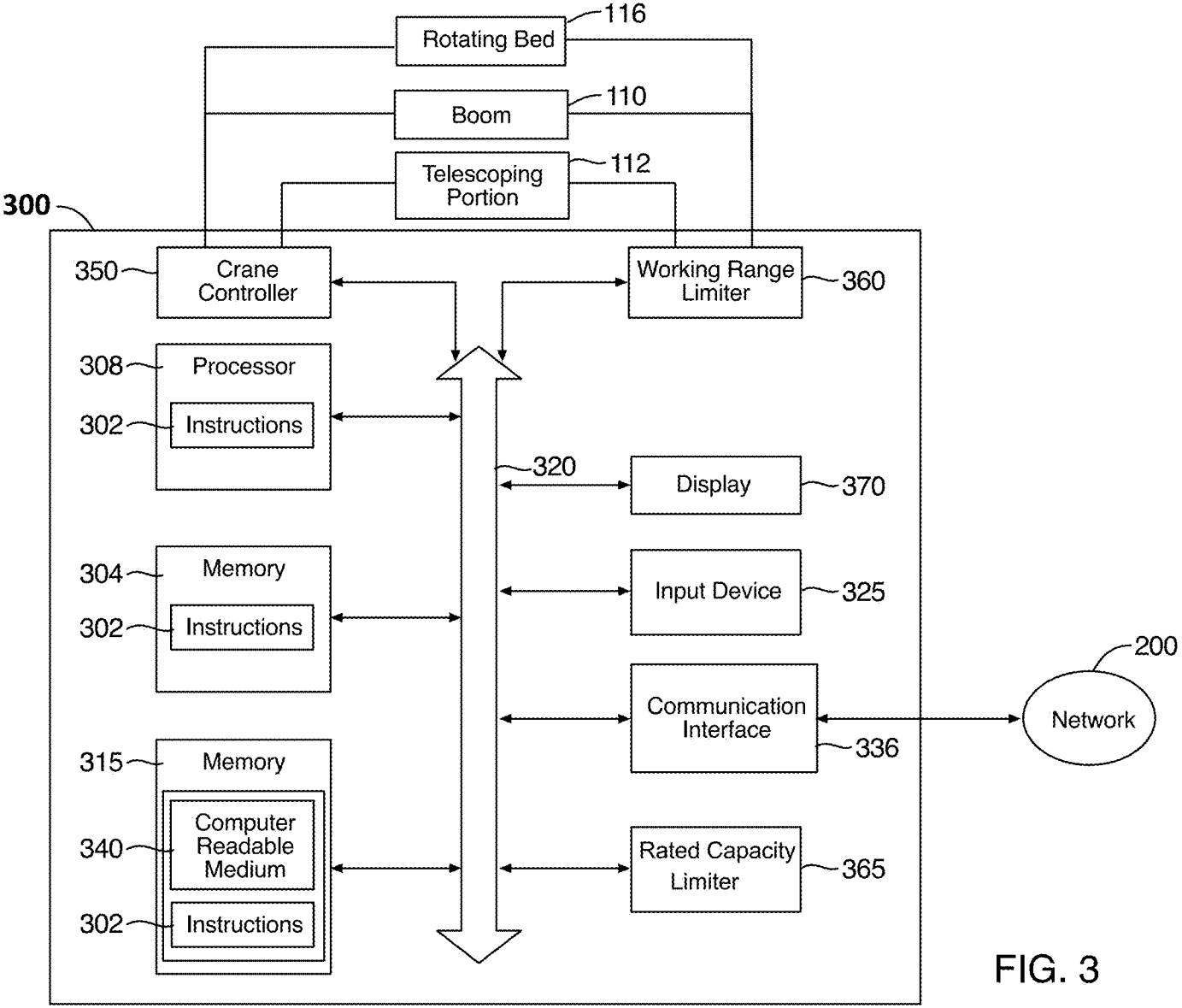
FIG. 3 illustrates a computer system, which may represent any of the computing devices referenced herein or that may execute the methods or logic of the present disclosure.

FIG. 3 illustrates a computer system 300 (or other computing device), which may represent a cab computing device 300 or a wireless network computer, or any other computing device referenced herein or that may be used to execute the disclosed methods or logic disclosed. The computer system 300 may include an ordered listing or a set of instructions 302 that may be executed to cause the computer system 300 to perform any one or more of the methods or computer-based functions disclosed herein. The computer system 300 may operate as a stand-alone device or may be connected, e.g., using a network 200, to other computer systems or peripheral devices, for example.

In a networked deployment, the computer system 300 may operate in the capacity of a server or as a client-user computer in a server-client user network environment, or as a peer computer system in a peer-to-peer (or distributed) network environment. The computer system 300 may also be implemented as or incorporated into various devices, such as a personal computer or a mobile computing device capable of executing a set of instructions 302 that specify actions to be taken by that machine, including and not limited to, execution of certain applications, programs, and with the option of accessing the Internet or Web through any form of browser. Further, each of the systems described may include any collection of sub-systems that individually or jointly execute a set, or multiple sets, of instructions to perform one or more computer functions.

The computer system 300 may include a memory 304 on a bus 320 for communicating information. Code operable to cause the computer system to perform any of the acts or operations described herein may be stored in the memory 304. The memory 304 may be a random-access memory, read-only memory, programmable memory, hard disk drive or any other type of volatile or non-volatile memory or storage device.

The computer system 300 may include a processor 308, such as a central processing unit (CPU) and/or a graphics-processing unit (GPU). The processor 308 may include one or more general processors, digital signal processors, application specific integrated circuits, field programmable gate arrays, digital circuits, optical circuits, analog circuits, combinations thereof, or other now known or later-developed devices for analyzing and processing data. The processor 308 may implement the set of instructions 302 or other software program, such as manually programmed or computer-generated code for implementing logical functions. The logical function or any system element described may, among other functions, process and/or convert an analog data source such as an analog electrical, audio, or video signal, or a combination thereof, to a digital data source for audio-visual purposes or other digital processing purposes such as for compatibility of computer processing.

The computer system 300 may also include a disk or optical drive unit 315. The disk drive unit 315 may include a computer-readable medium 340 in which one or more sets of instructions 302, e.g., software, can be embedded. Further, the instructions 302 may perform one or more of the operations as described herein. The instructions 302 may reside completely, or at least partially, within the memory 304 and/or within the processor 308 during execution by the computer system 300. One or more databases in memory may store a Cartesian coordinate system, and may relate positions of obstacles and the boom a crane to each other in 3D space within the database.

The memory 304 and the processor 308 also may include computer-readable media as discussed above. A "computer-readable medium," "computer-readable storage medium," "machine readable medium," "propagated-signal medium," and/or "signal-bearing medium" may include any device that includes, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium.

The computer system 300 may further include a crane controller 350, a working range limiter 360, and a rated capacity limiter 365. The crane controller 350 may be coupled with the processor 308 and the bus 320 and be configured to control components of the crane, including the boom 110 and the rotating bed 116, in response to receiving control signals from the processor 308.

The rated capacity limiter 365 (also referred to as a moment limiter in the art) provides information for crane operators to ensure that the crane devices work safely in the range of design parameters. The working range limiter 360 provides information for crane operators to ensure that the crane devices work safely outside of a restricted volume. The working range limiter 360 and the rated capacity limiter 365 may each monitor the operations of the crane through a plurality of sensors, and provide information regarding the limits of the cranes to an operator. In some embodiments the functionality of the working range limiter 360 and the rated capacity limiter 365 may be combined into a single unit. When the crane 90 lifts objects, the reading changes continuously with the operation of the crane 90. The sensors provide information on the length and angle of the crane boom 110, the lifting height and range, the rated load, the lifted load and so on. If the crane 90 works nearly beyond the permitted scope, the rated capacity limiter 365 and/or the working range limiter 360 may sound an alarm, may light an indicator, or modify the operation of the crane. In some embodiments, the working range limiter 360 may also be adapted to act as a controller of the boom 110, the telescoping portion 112, and the rotating body 116 to allow the crane 90 to continue operation while avoiding the restricted volume.

Additionally, the computer system 300 may include an input device 325, such as a keyboard and/or mouse, configured for a user to interact with any of the components of the computer system 300. It may further include a display 370, such as a liquid crystal display (LCD), a cathode ray tube (CRT), or any other display suitable for conveying information. The display 370 may act as an interface for the user to see the functioning of the processor 308, or specifically as an interface with the software stored in the memory 304 or the drive unit 315.

The computer system 300 may include a communication interface 336 that enables communications via the communications network 200. The network 200 may include wired networks, wireless networks, or combinations thereof. The communication interface 336 network may enable communications via any number of communication standards, such as 802.11, 802.17, 802.20, WiMax, cellular telephone standards, or other communication standards.

Accordingly, the method and system may be realized in hardware, software, or a combination of hardware and software. The method and system may be realized in a centralized fashion in at least one computer system or in a distributed fashion where different elements are spread across several interconnected computer systems. A typical combination of hardware and software may be a general-purpose computer system with a computer program that, when being loaded and executed, controls the computer system such that it carries out the methods described herein. Such a programmed computer may be considered a special-purpose computer, and be specially adapted for placement within the cab 120 and control of the crane 90.

The method and system may also be embedded in a computer program product, which includes all the features enabling the implementation of the operations described herein and which, when loaded in a computer system, is able to carry out these operations. Computer program in the present context means any expression, in any language, code or notation, of a set of instructions intended to cause a system having an information processing capability to perform a particular function, either directly or after either or both of the following: a) conversion to another language, code or notation; b) reproduction in a different material form.

The order of the steps or actions of the methods described in connection with the disclosed embodiments may be changed as would be apparent to those skilled in the art. Thus, any order appearing in the Figures or described with reference to the Figures or in the Detailed Description is for illustrative purposes only and is not meant to imply a required order, except where explicitly required.

Figure 9:
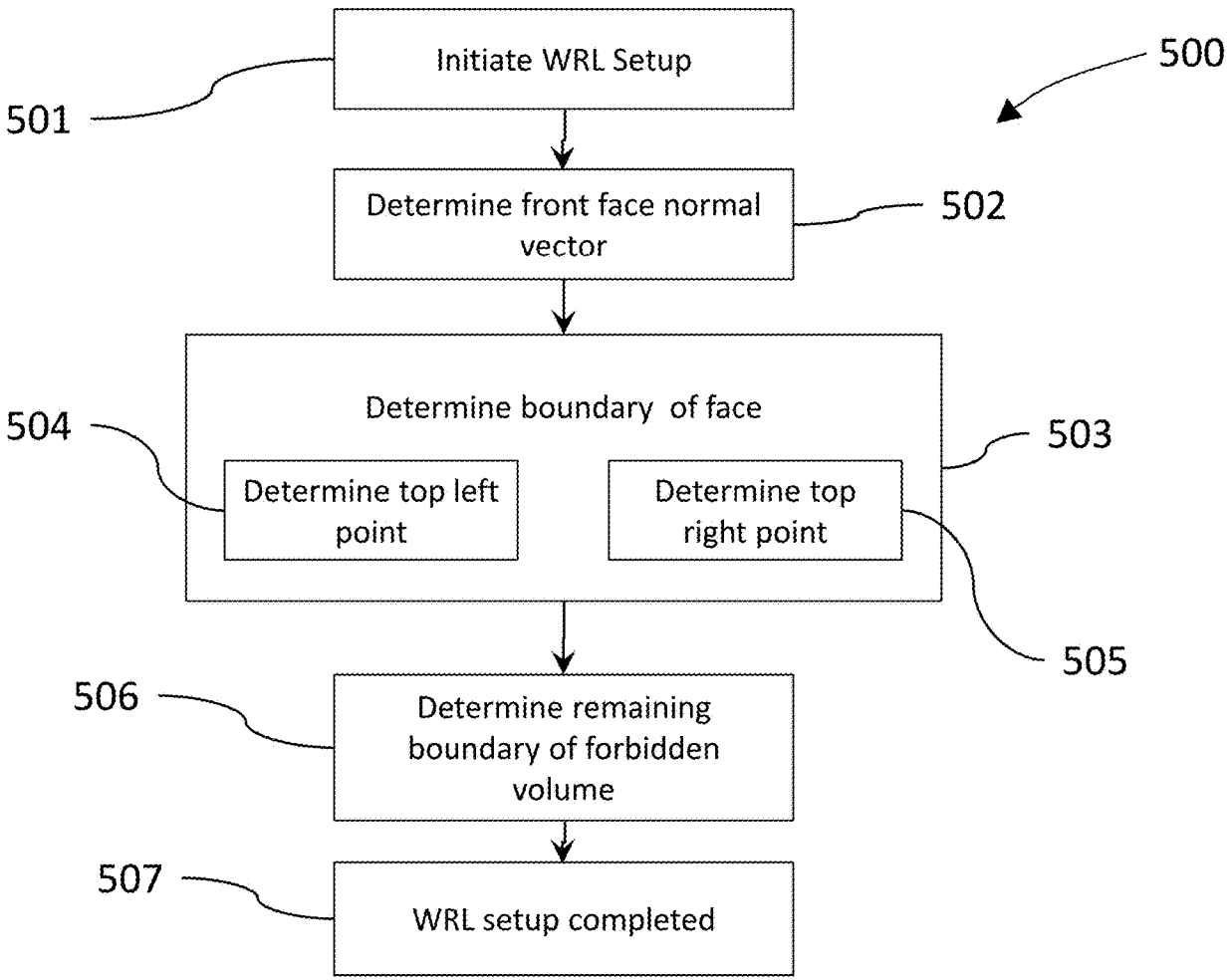
FIG. 9 is a flow chart of a method for setting up a crane control system.
Figure 10:
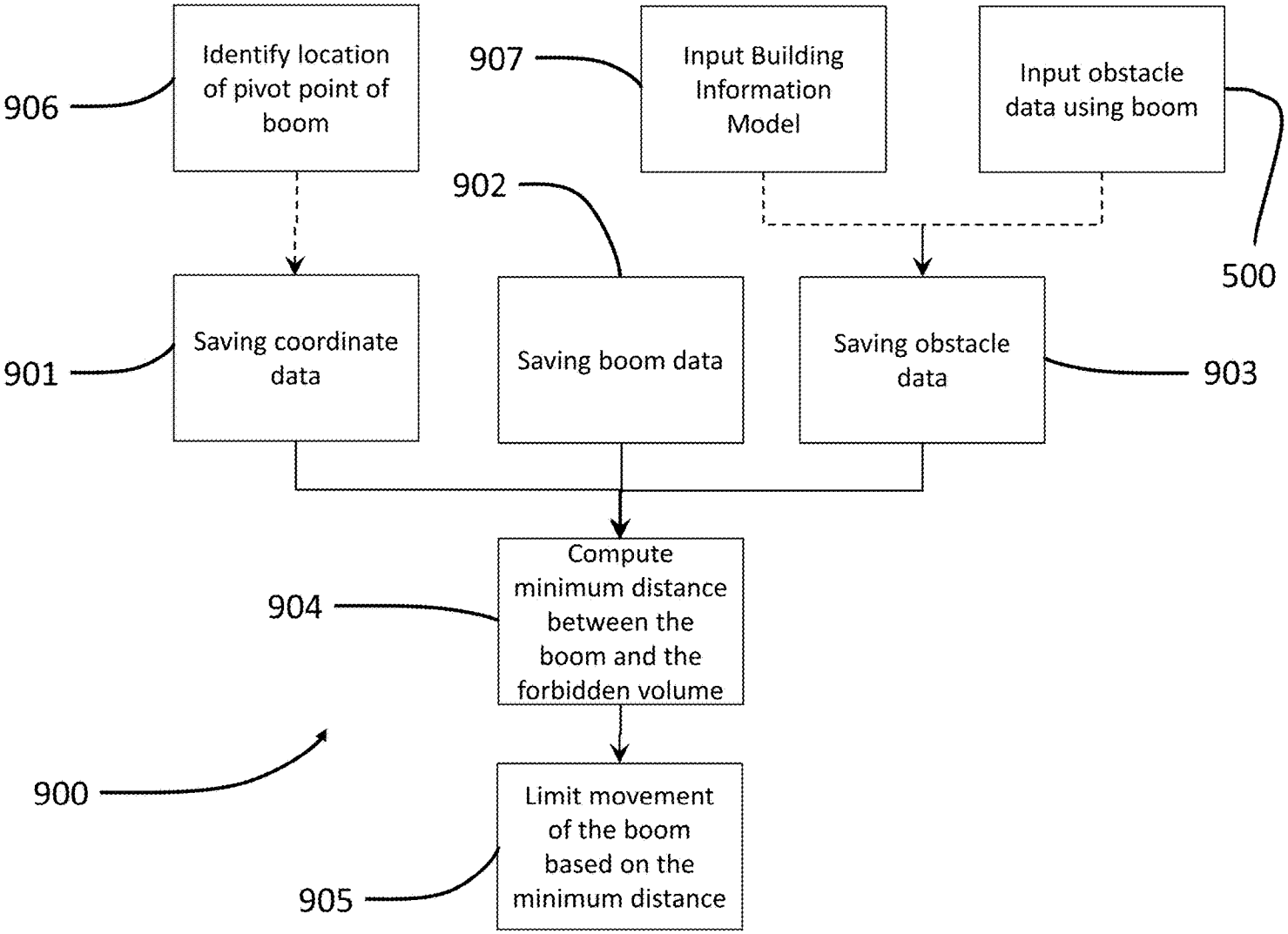
FIG. 10 is a flow chart of a method for limiting the operation of a boom.

FIG. 9 provides a high level flow chart of a method 500 for setting up a WRL for a crane and FIG. 10 illustrates a high level flow chart of a method 900 for altering crane functions during crane use. The method will be described in relation to FIG. 4 and FIG. 5. The method for setting up a WRL for a crane begins at step 501 in which the WRL setup process is initiated. This may be done by a crane operator or other personnel. The process may be done manually, it may be an automated process, or a combination of manual and automated.

Figure 4:
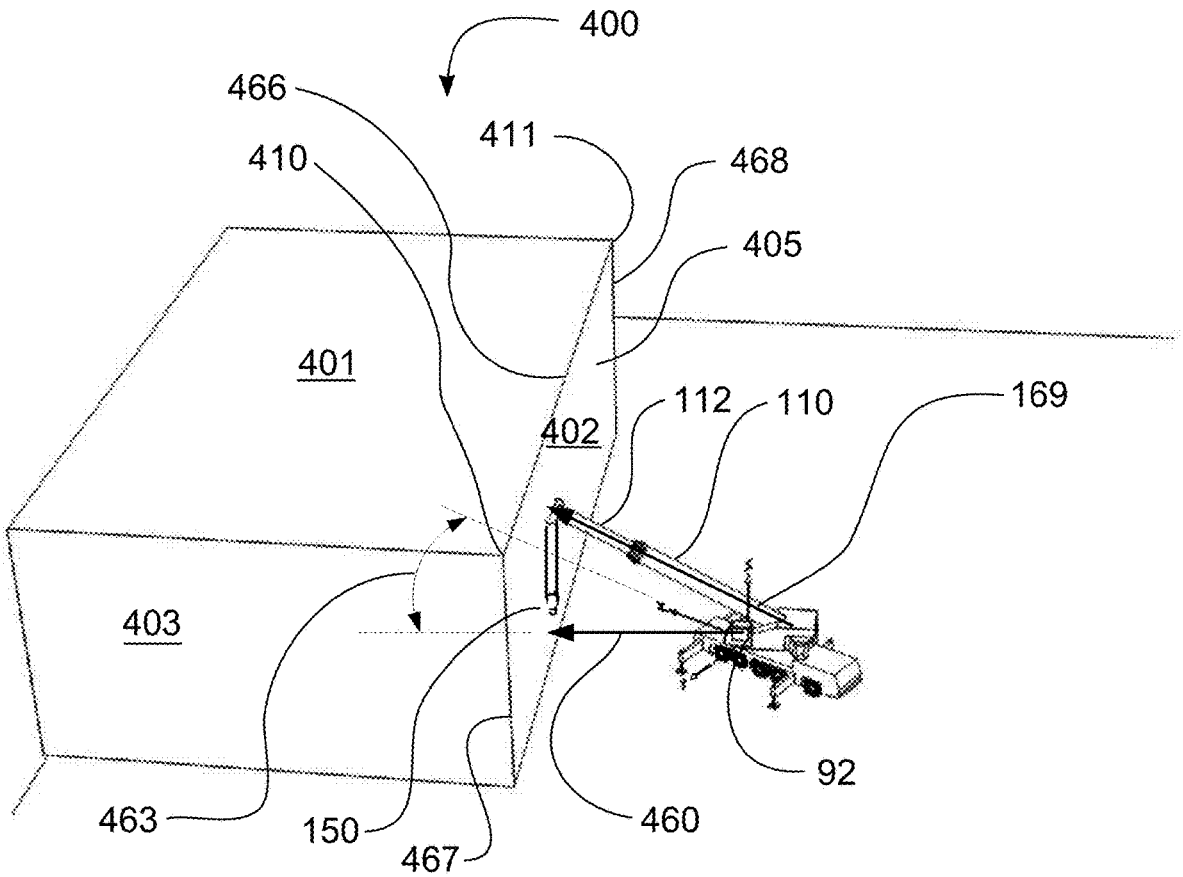
FIG. 4 is a perspective view of a forbidden volume and a crane.

FIG. 4 illustrates a three-dimensional model of a forbidden volume 400 corresponding to the outline 96 of building 80. The process of setting up the WRL defines the forbidden volume 400 in relation to the crane. The forbidden volume 400 may correspond to other obstacles or volumes in which crane operation is not permitted. In the example of the rectangular forbidden volume 400 of FIG. 4, the boundaries of the forbidden volume 400 are defined by four rectangular planar faces. A first plane 401 would be above the forbidden volume 400. A second plane 402 would be facing the crane. A third plane 403 would be to the left of the forbidden volume (as seen by the crane). The fourth plane 404 would be to the right of the forbidden volume (behind plane 401 and not visible in the figure). This forbidden volume 400 is referred to as a quasi-volume since an actual rectangular solid would have 6 faces; the face at ground level of the forbidden volume 400 and the face at the back of the forbidden volume 400 (as seen from the crane) are not considered relevant and may be ignored.

The definition of the quasi-volume can begin with the plane 402 that contains the front rectangular face 405. To define this plane 402, in block 502, a vector normal to the face 405 is found, as well as a point contained within the plane 402. Both of these can be provided by the definition of a vector 460 that points from the origin 92 of the coordinate system 98 to the forbidden volume 400 that is normal to the front rectangular face 405. This vector 460 is referred to as $\vec{R}_{Bldg}$.

The direction of vector 460 is found by swinging the rotating bed 116 of the crane to point the boom 110 towards the forbidden volume 400, and recording the swing angle 463 which is referred to as $\alpha_{Bldg}$. The magnitude of vector 460 (the vector endpoint providing a point contained within the plane 402) is created by extending the telescopic boom 110 to have the tip of the telescopic boom 110, where the hook block is located, at the distance desired for the creating quasi-volume front face 405, and recording the current hook radius (which is a common element measured by a crane control system). For this step the hook block can be at any desired height.

Note that the preferred embodiment is not expected to have the quasi-volume be coincident with the actual building object. The quasi-volume would be expected to have some buffer or distance away from the building object. The positioning of the hook block is actually indicating the buffer desired. In another embodiment, if the actual building object location was desired for the quasi-volume, a manual measurement could be taken from the hook block to the actual building, and this value manually entered to the programming to be added to the $\vec{R}_{Bldg}$ magnitude. Manual measurement may be necessary to prevent accidental impact between the boom 110 and the object. Also note that the vector, $\vec{R}_{Bldg}$ 460 is in the XY plane of the coordinate system 98; therefore, the boom up/down angle is not relevant. The crane operator may use his normal view of the building object to point the boom 110 at the object. While it is preferable that the vector $\vec{R}_{Bldg}$ 460 be perpendicular to the face 405, the swing angle 463, $\alpha_{Bldg}$, may be off from the true perpendicular direction without introducing large errors. If the swing angle 463 is off by 5 degrees in either direction, it will only introduce a 0.4% error in radial distance for the vector 460, $\vec{R}_{Bldg}$.

With the front face plane 402 defined by vector, $\vec{R}_{Bldg}$ 460, the boundary of the face 405 may be determined in block 503. The boundary of the face 405 may be defined by two locations, the left top point 410 and the right top point 411 for the quasi-volume. The locations are determined by pointing the boom 110 at each location 410, 411 on the actual building object and recording the swing angle and the boom angle. For other building shapes, other points may be used.

Figure 5:
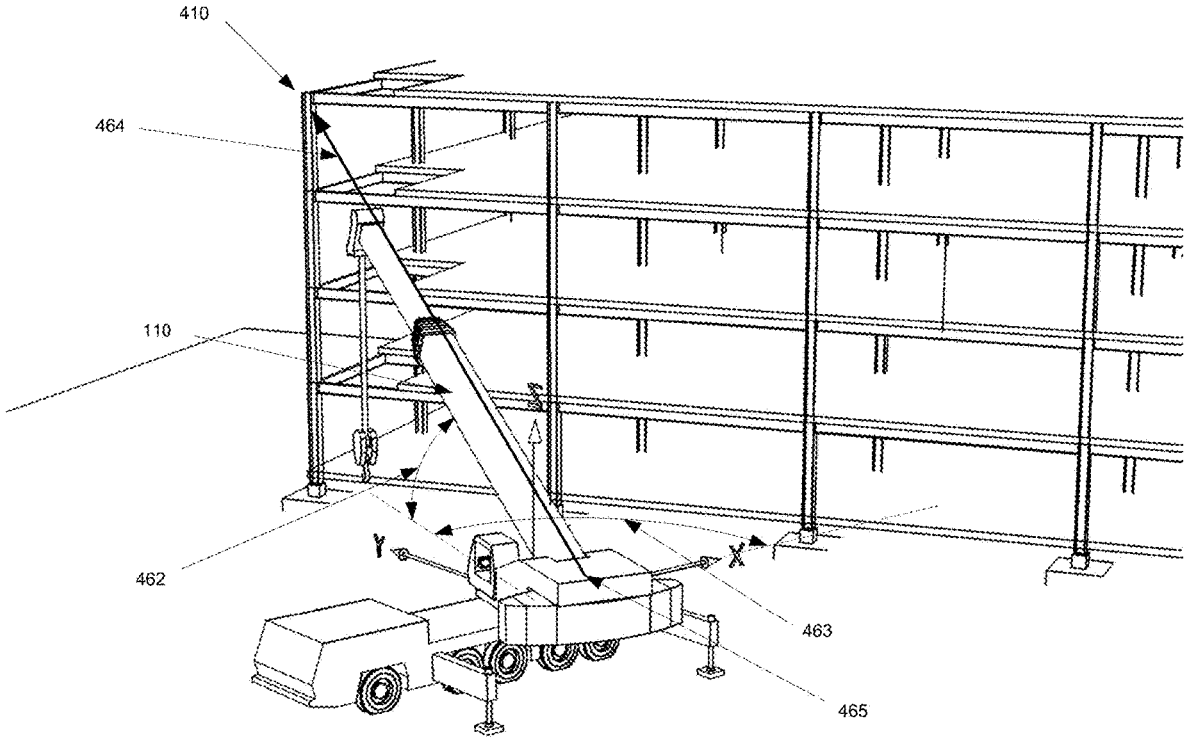
FIG. 5 is a perspective view of a building and a crane determining the location of the upper left point of a building.

FIG. 5 illustrates an example of determining the position of the top left location 410, as done in block 504. With the boom pointed at this location 410, the swing angle 463 is recorded as $\alpha_{Left}$ and the boom angle 462 is recorded as $\beta_{Left}$. These angles, along with the position of the boom pivot point 465, which is known within the coordinate system 98, are used to create a direction vector, $\vec{r}_{Left}$ 464. The length of the boom 110 and the position of the hook block 150 may be at any value and are not important at this time. The left top point 410 may now be determined by intersecting the direction vector 464 $\vec{r}_{Left}$ and the plane for the front face 402 to obtain the location of the left top point 410 $\vec{R}_{Left}$.

In block 505, a similar procedure is used for the other top location 411 by intersecting a similar direction vector, $\vec{r}_{Right}$ from pointing the boom 110 to the top right location 411 and intersecting the direction vector $\hat{r}_{Right}$ with the plane for the front face 402 to obtain the location of the right top point $\vec{R}_{Right}$.

The front top edge 466 is now defined by these two points, and can be modeled as $\vec{R}_{FrontTop}=\vec{R}_{Right}-\vec{R}_{Left}$. A direction unit vector for the front top edge is $$\hat{r}_{FrontTop} = \frac{\vec{R}_{FrontTop}}{|\vec{R}_{FrontTop}|}.$$

A direction unit vector for the normal to the front face 405 is $$\hat{r}_{Bldg} = \frac{\vec{R}_{Bldg}}{|\vec{R}_{Bldg}|}.$$

A direction unit vector for the left edge 467 and right edge 468 of the front face, pointing from the top points 410 and 411 to the ground is $\hat{r}_{Down}=-\hat{k}$, where $\hat{k}$ is the unit vector for the vertical direction and is aligned with the Z axis of the coordinate system 98.

The extent of the left edge 467 and the right edge 468, can be any value that is sufficient to cover the height of the building or forbidden zone; the bottom edge of the quasi-volume is not relevant to the crane operation, so the distance can extend into the ground; for instance, it might be set to 500 meters. This extent can be applied to the direction vector $\hat{r}_{Down}$ to arrive at points for the remaining vertices of the front face 402.

In block 506, the remainder of the forbidden zone is determined. For the top face 401, the left top location point 410 and the right top location point 411 already define two of the points on the top face 401. The $\hat{r}_{Bldg}$ direction vector 460 is used to set the other two points for the top face. As with the front face 402, any value for the extent of the face can be used that is sufficient to cover the reach of the crane; again, it might be set to 500 meters. Telescopic booms are often used to position a load on top of the building object, and not beyond it, so this extent is not considered critical.

For the left face 403, as well as the right face 404, the left top location point and the left lower location point already define two of the points on the face. The $\hat{r}_{Bldg}$ direction vector is used to set the other two points for the face. As with the top face, any value for the extent of the face can be used that is sufficient to cover the reach of the crane; again, it might be set to 500 meters. In block 507 the WRL setup is completed.

Figure 6:
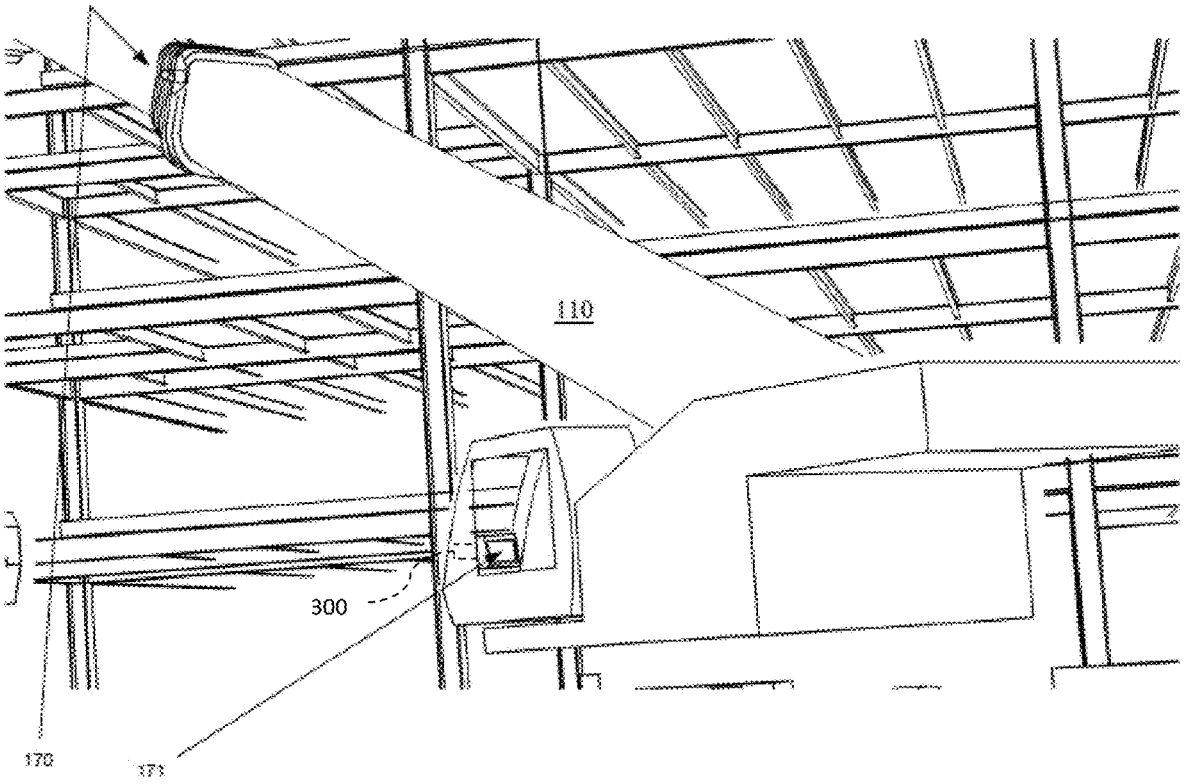
FIG. 6 is a perspective view of a boom having an electronic assist device for aiming the boom.

As shown in FIG. 6, the positioning of the boom 110 to point the boom 110 at the locations may be enhanced by manual or electronic assistance. For manual assistance, ground personnel might be positioned behind the crane as the boom 110 is pointed, and the ground personnel could indicate to the crane operator when the boom is properly oriented. Preferred embodiments would be electronic assistance in the form of a video camera system. The camera 170 would be aligned with the non-telescopic base section of the boom 110. A crane operator video display 171 would show the orientation of the boom 110 to point at the critical locations. Note that the deflection or sagging of the telescopic boom 110 would not affect the point locations since the modeling is based on the orientation of the base section (the boom angle and swing angle).

In another embodiment, the positioning of the boom may be enhanced using a pointing device 700 on a base section of the boom 110. For example, the pointing device 700 may identify a location (and thus boom and swing angles) such as the top left or top right corner of the forbidden volume. This information may be recorded by the computer system 300, and may be combined with a distance determined between the end of the boom 110 (where a crane hook 150 naturally hangs down). The pointing device 700 may be a camera, a laser, or other pointing device for lining up with a determined threshold of accuracy the boom with the outer boundaries of the obstacle 400. In some embodiments, the pointing device 700 may further contain a distance measurement device such as a laser rangefinder to determine a distance between the location and the end of the boom. The distance between the end of the boom and the location may then be converted into a distance in the XY plane.

The distance between the end of the crane 90 (or from the crane hook 150) and the forbidden volume 400 may be determined manually or with a computing device. The distance may be based on a minimum distance from a centerline-of-rotation of the boom with respect to the obstacle 400, e.g., from the hook 150 a distance taken perpendicularly to a middle section of the obstacle.

With the forbidden quasi-volume now defined within the coordinate system, and considering that the boom is also represented as a known vector (169) within the coordinate system, the invention can provide appropriate alterations of the control system to avoid undesirable interactions between the boom and the job site object using the method 900 of FIG. 10.

In block 901 coordinate data is saved to memory. The coordinate data provides a reference for orientating the crane and its special relationship to objects around it. One example of saving coordinate data includes identifying the location of the pivot point of the boom as shown in block 906. In block 902, boom data is saved to memory. The boom data may be the known vector 169 and may be determined automatically by the crane control system. In block 903, obstacle data is saved to memory. The obstacle data may be saved to memory using the method 500 shown in FIG. 9. In some embodiments, a building information model (BIM) may loaded into memory as shown in block 907. The boom is modeled as known vector 169 and the vector data is saved to memory during operation of the crane. The distance from the boom to the quasi-volume features (such as faces and edges) is computed in block 904. The known vector for the boom is referred to as $\vec{R}_{Boom}$ This is used to compute a direction unit vector as follows:

$$\hat{r}_{Boom} = \frac{\vec{R}_{Boom}}{|\vec{R}_{Boom}|}.$$

Figure 8:
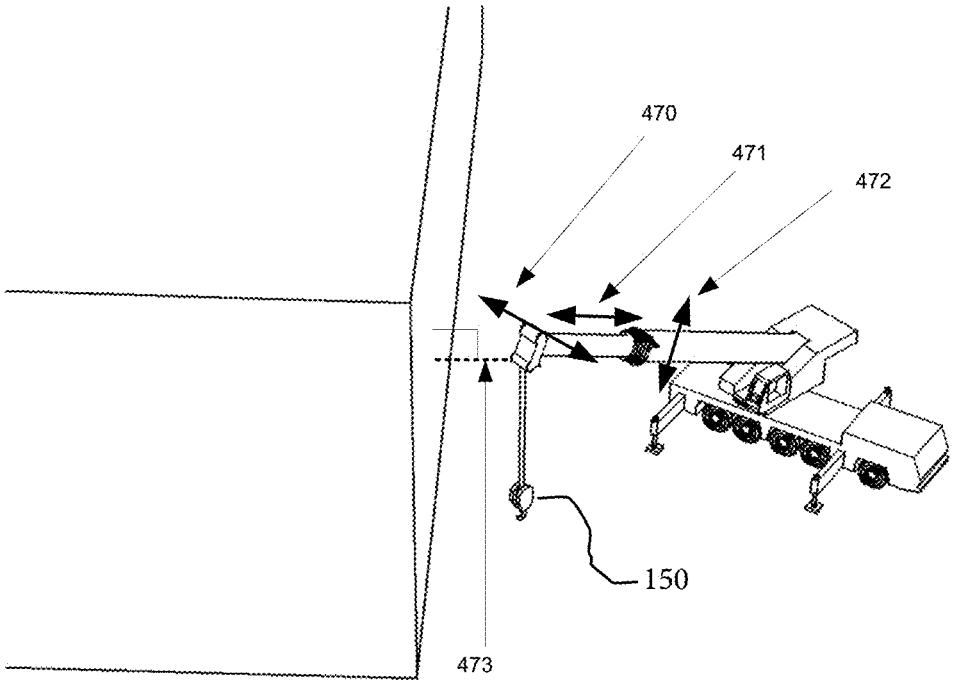
FIG. 8 is a perspective view of a forbidden volume and a crane showing a proximity vector between the boom and the forbidden volume.

This distance is the basis for a critical proximity vector 473, which is the minimum distance between a point on the boom and the forbidden volume. With the boom modeled as a known vector 169, vectors may be computed for crane function motions. The first motion is the telescoping motion 471, the second motion is swinging left and right 470, and the third motion is boom up/down 472. For each motion there is a direction, and they are represented by six unit vectors within the coordinate system as follows: Telescope out: $\hat{t}_{TO}$, Telescope in: $\hat{t}_{TI}$Swing left: $\hat{t}_{SL}$, Swing right: $\hat{t}_{SR}$, Boom up: $\hat{i}_{BU}$, and Boom down: $\hat{t}_{BD}$. The telescope out unit vector is coincident with the boom vector 169 and is computed as $\hat{t}_{TO}=\hat{r}_{Boom}$. The telescope in unit vector is $\hat{t}_{TI}=-1\cdot\hat{t}_{TO}$. The swing left direction vector is computed as $\vec{T}_{SL}=\hat{k}\times\hat{t}_{TO}$, the swing left unit vector is computed as $$\hat{t}_{SL} = \frac{\vec{T}_{SL}}{|\vec{T}_{SL}|},$$

and the swing right unit vector is $\hat{t}_{SR}=-1\cdot\hat{t}_{SL}$. The boom up unit vector is computed as $\hat{t}_{BU}\hat{t}_{TO}\times\hat{i}_{SL}$ and the boom down unit vector is $\hat{t}_{BD}=-1\cdot\hat{t}_{BU}$. The critical proximity vector 473 starts at the nearest point on the boom, and this point may be along the length of the boom (and not at the end of the boom). FIG. 8 illustrates a critical proximity vector 473 from the end of the boom to the front face of the quasi-volume. The critical proximity vector 473 $\vec{T}_{Prox}$ is converted to a direction unit vector as follows:

$$\hat{t}_{Prox} = \frac{\vec{T}_{Prox}}{|\vec{T}_{Prox}|}.$$

In block 905, a scale factor for each crane function is determined for alterations of the control system. A value of 1.0 for a particular scale factor would indicate the crane function would be unaltered. A value of 0.0 for a particular scale factor would indicate the crane function would be shutdown. A value of 0.5 for a particular scale factor would indicate the crane function would be slowed by 50 percent.

The scale factors correspond to the six crane functions as follows: Telescope out: $f_{TO}$; Telescope in: $f_{TI}$; Swing left: $f_{SL}$; Swing right: $f_{SR}$; Boom up: $f_{BU}$; and Boom down: $f_{BD}$.

The value for the scale factor may be based on two thresholds for the critical proximity distance 473. The critical proximity distance is $d_{Prox}=|\vec{T}_{Prox}|$. As the crane boom approaches the quasi-volume, this critical proximity distance decreases. When the critical proximity distance reaches a slowdown threshold ($\delta_1$), the crane function will begin to slow down. When the critical proximity distance reaches a shutdown threshold ($\delta_0$), the crane function will stop. These thresholds may be universal for the crane (applied to all crane functions), or the thresholds may be specific to each function. Considering the drift that is typical when stopping crane swing motions, particular threshold values for the swing function would be expected. However, the preferred embodiment described here will use a universal value for simplicity.

The critical proximity distance and the thresholds are used to create a scaling of the crane function based on the degree to which the proximity distance is between the thresholds as follows:

$$\varepsilon_{Prox} = \frac{\delta_1 - d_{Prox}}{\delta_1 - \delta_0}.$$

This relationship may be applied if the critical proximity distance has "entered" the threshold "zone". Otherwise, the crane functions would not be altered and the scale factors would be set to 1.0.

The degree to which each crane function may require alteration within the threshold zone may be based on the position of the boom. The degree of alteration may be based on taking the dot product of the critical proximity unit vector and the earlier computed crane motion direction unit vectors. If the crane boom is swinging left toward a wall on the left, the critical proximity vector will be pointing to the left (from the boom to the wall), and the swing left motion vector will likewise be pointing to the left. The dot product in this case will be relatively close to 1, and would indicate that the swing left function should be directly altered. However, the swing right direction will be a unit vector pointing to the right; and the dot product in this case (still with respect to the critical proximity vector pointing to the left) will be relatively close to −1. The following computations determine the crane function alteration factors (one for each function direction):

$\varepsilon_{TO}=\hat{t}_{TO}\cdot\hat{t}_{Prox}$ $\varepsilon_{TI}=\hat{t}_{TI}\cdot\hat{t}_{Prox}$
$\varepsilon_{SL}=\hat{t}_{SL}\cdot\hat{t}_{Prox}$
$\varepsilon_{SR}=\hat{t}_{SR}\cdot\hat{t}_{Prox}$
$\varepsilon_{BU}=\hat{t}_{BU}\cdot\hat{t}_{Prox}$
$\varepsilon_{BD}=\hat{t}_{BD}\cdot\hat{t}_{Prox}$ The process of determining the crane function scale factors is now described. Initially the crane function scale factors may be set to 1.0. Each crane function direction may then be evaluated. If the critical proximity distance is between the crane function thresholds, and the direction dot product indicates that the crane function direction should be altered, then the scale factor may be computed as one of the following (depending on the crane function direction being evaluated):

$f_{TO}=-1-\varepsilon_{Prox}\cdot\varepsilon_{TO}$
$f_{TI}=-1-\varepsilon_{Prox}\cdot\varepsilon_{TI}$
$f_{SL}=-1-\varepsilon_{Prox}\cdot\varepsilon_{SL}$
$f_{SR}=-1-\varepsilon_{Prox}\cdot\varepsilon_{SR}$
$f_{BU}=-1-\varepsilon_{Prox}\cdot\varepsilon_{BU}$
$f_{BD}=-1-\varepsilon_{Prox}\cdot\varepsilon_{BD}$ If the direction dot product indicates that a crane function direction should be altered, and the critical proximity distance is at or beyond the shutdown threshold, the crane function scale factor would be set to 0.0.

In another example, there may be a building information model (BIM) of the obstacle (such as a building, or other non-rectangular-shaped object), then the BIM may be incorporated into the crane 3D workspace when there are at least two points available with which to align the BIM within the coordinate system.

The present disclosure is not limited for use in conjunction with a mobile crane, however. For example, the embodiments described above, including, for example, the techniques, systems, analyses and methods described above, may be implemented with a tower crane 1090 as well. Further description of the various techniques, systems, analyses, methods and the like described above may be omitted below, where the techniques, systems, analyses, methods and the like in the embodiments below are the same or substantially the same as those described above.

As will be described below, a tower crane includes a mast, a rotating bed coupled to the mast, a boom mounted on the rotating bed and a hook block connected to the boom. In one embodiment, a method for controlling a crane component of a tower crane in proximity of obstacles at a worksite includes, saving, in the memory, coordinate date representing a coordinate system at the worksite having an origin at a base of an axis of rotations of the rotating bed and fixed relative to the mast, wherein the boom is rotatable on the axis of rotation. The method also includes saving, in the memory, obstacle data representing a forbidden volume in the coordinate system. In addition, the method includes saving, in the memory crane component data representing the location of the crane component. The crane component data may be, for example, a modeled crane component stored in the memory. Movement of the crane component may be limited, by the computing device, to avoid the crane component entering the forbidden volume. Such limiting is based on a computed minimum distance between the crane component and the forbidden volume using the coordinate data, the obstacle data and the crane component data. The crane component may be, for example, one or more of the boom and the hook block. As described below, the boom may be a luffing jib or a hammerhead jib, for example.

In another embodiment, a system for controlling the crane component in proximity of obstacles at the worksite includes a crane control system (also referred to herein as a "crane controller") configured to control operation of the crane component, a processor in operable communication with the crane control system, and a memory in operable communication with the processor, the memory storing data. The data includes data representing the crane component, data representing the forbidden volume and computer executable instructions for execution by the processor. The instructions are configured to calculate a minimum distance between the crane component and the forbidden volume based on the data representing the crane component and the data representing the forbidden volume. The instructions may then cause the crane control system to control movement of the crane component based on the calculated minimum distance. The crane component is one or more of the boom and the hook block.

Referring generally to FIGS. 11-20, in one embodiment, the crane may be a tower crane 1090. The tower crane 1090 includes a lower works in the form of a tower crane mast 1093, which is configured for engagement with the ground. The tower crane 1090 also includes an upper works in the form of a rotating bed 1116. The rotating bed 1116 is coupled to the mast 1093 and is configured to rotate relative to the mast 1093 on an axis of rotation 1094. In one embodiment, an operator's cab 1120 may be attached to the rotating bed 1116.

Figure 11:
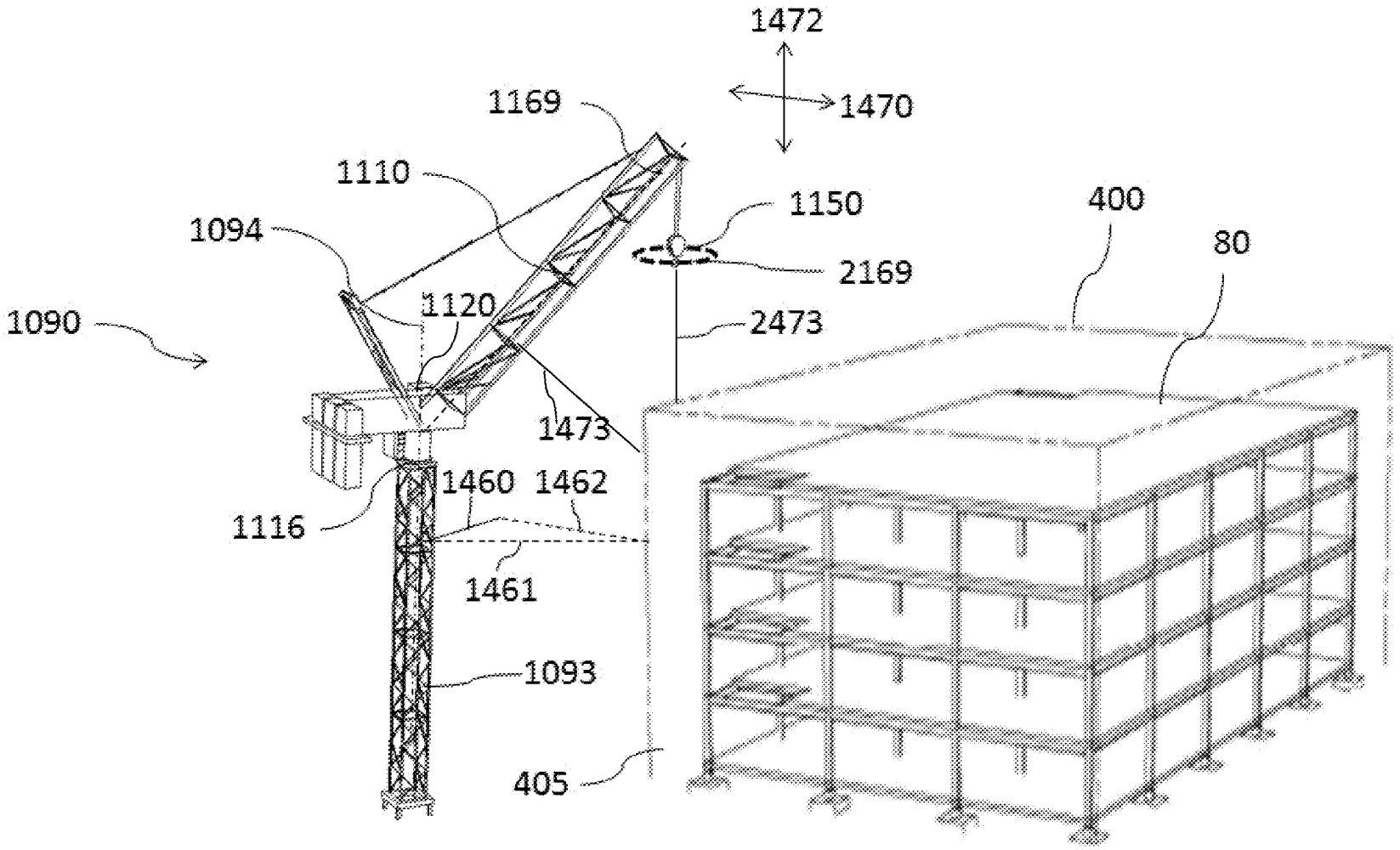
FIG. 11 is a perspective view showing a crane and obstacle at a jobsite, according to an embodiment.

The tower crane 1090 also includes a boom 1110, 2110 mounted on the rotating bed 1116. As understood by those skilled in the tower crane art, the boom 1110, 2110 may also be referred to as a jib, such as a hammerhead jib, or a luffing jib, as will be described below. Hammerhead jibs include, for example, saddle jibs and flattop jibs. Hammerhead jibs include a trolley moving underneath and alongside the jib and a hook block suspended by one or more flexible members from the trolley. In the tower crane art, it is also understood that a hammerhead jib may incorporate two trolleys and a hook block suspended therefrom, utilizing specific reeving of the flexible member(s) onto the double trolley arrangement (not shown). Referring to FIG. 11, in one embodiment, the boom may be a luffing jib 1110. The luffing jib 1110 is configured for swinging, or slewing, movements, i.e., swing-left and swing-right movements, about the axis of rotation 1094 in response to rotation of the rotating bed 1116. The luffing jib 1110 is also configured for lifting, or luffing, movements, i.e., boom-up and boom-down movements. The boom-up and boom-down movements change a lift, or luffing, angle of the luffing jib 1110. The lift angle is an angle of the luffing jib 1110 relative to the horizontal.

A hook block 1150 may be suspended from a free end of the luffing jib 1110, and connected thereto with a flexible member, such as a rope. The hook block 1150 is configured for vertical movements in response to hoist-in and hoist-out functions, which cause the rope to be wound or unwound, respectively, from a hoist (not shown). Vertical movement of the hook block 1150 may also be affected by the boom-up and boom-down movements. The boom-up and boom-down movements also move the hook block 1150 in a horizontal direction. That is, the boom-up and boom-down movements change a hook radius. The hook block 1150 is also configured for swinging movement with swinging movement of the luffing jib 1110.

Crane component movements may be controlled by the computer system 300, for example, by the crane controller 350. For example, the crane controller 350 may be operably connected to one or more actuators configured to control movements of the crane components. Such movement control may include, for example, starting or stopping movement, or changing a speed of the movement by increasing or decreasing movement speed. Such control may also include lock-out functionality to prevent movement or operation of crane components. In one embodiment, the crane components may include the luffing jib 1110, the rotating bed 1116, the hook block 1150 and/or the hoist. Accordingly, crane functions, including movements of the crane components, may be controlled.

In one embodiment, the computer system 300 is configured to control movement of the rotating bed 1116, which causes the luffing jib 1110 to swing left and swing right. The computer system 300 may also control the luffing jib 1110 to move up (boom-up) and move down (boom-down). These four directions (boom-up, boom-down, swing-left and swing-right) may each be represented by vectors, each of which may be processed and tracked using appropriate algorithms as will be explained. Interference with obstacles 80, such as a building, on a worksite may be avoided by conducting vector analysis and continual monitoring of the orientation of the luffing jib 1110.

A coordinate system has an origin at a base of the axis of rotation 1094 of the rotating bed 1116. In one embodiment, the coordinate system is the same as the coordinate system 98 described in the embodiments above, and shown, for example, in FIG. 2. Accordingly, the coordinate system may be fixed to the tower crane mast 1093 or fixed relative to the rotating bed 1116. Other coordinate systems are possible and could be based on any origin within the construction zone.

Figure 12:
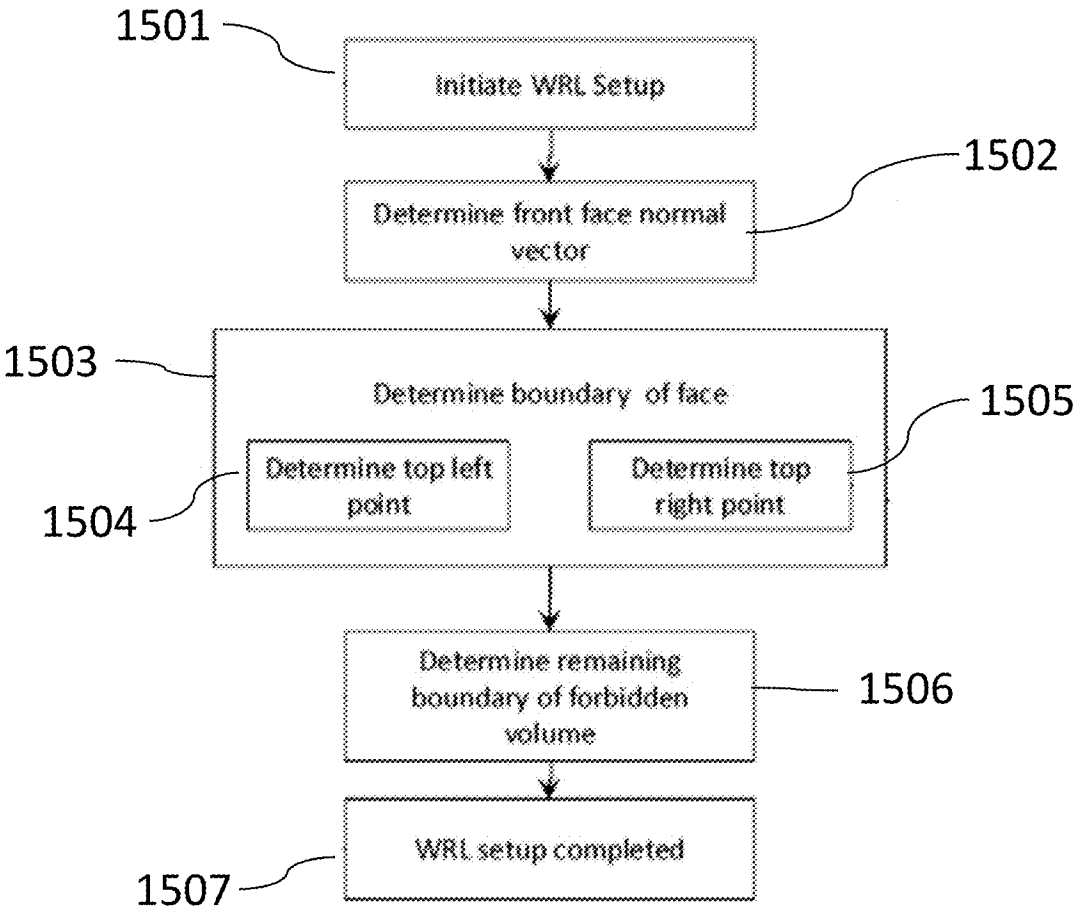
FIG. 12 is a flow chart of a method for setting up a crane control system, according to an embodiment.
Figure 13:
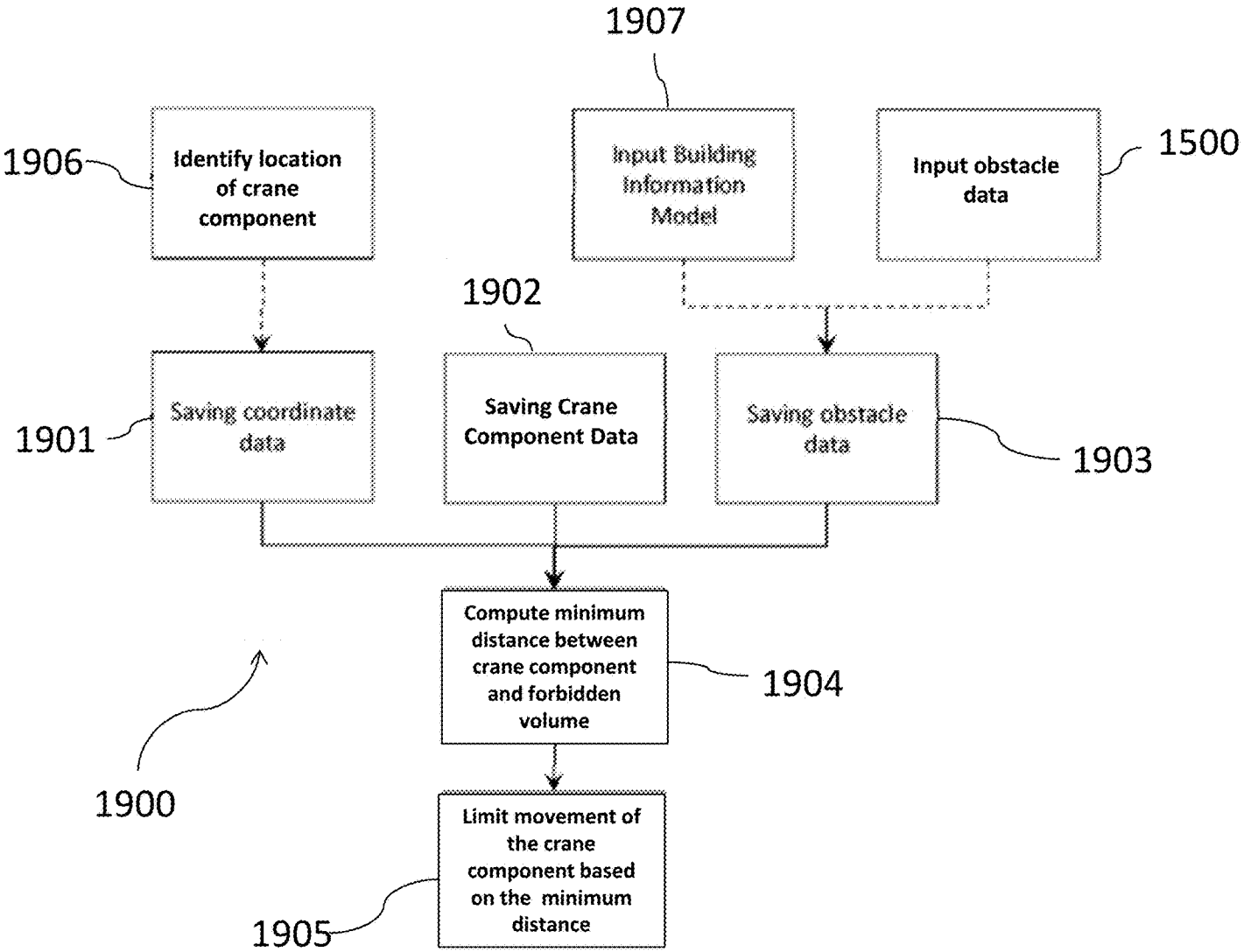
FIG. 13 is a flow chart of a method for limiting the operation of a crane component, according to an embodiment.
Figure 14:
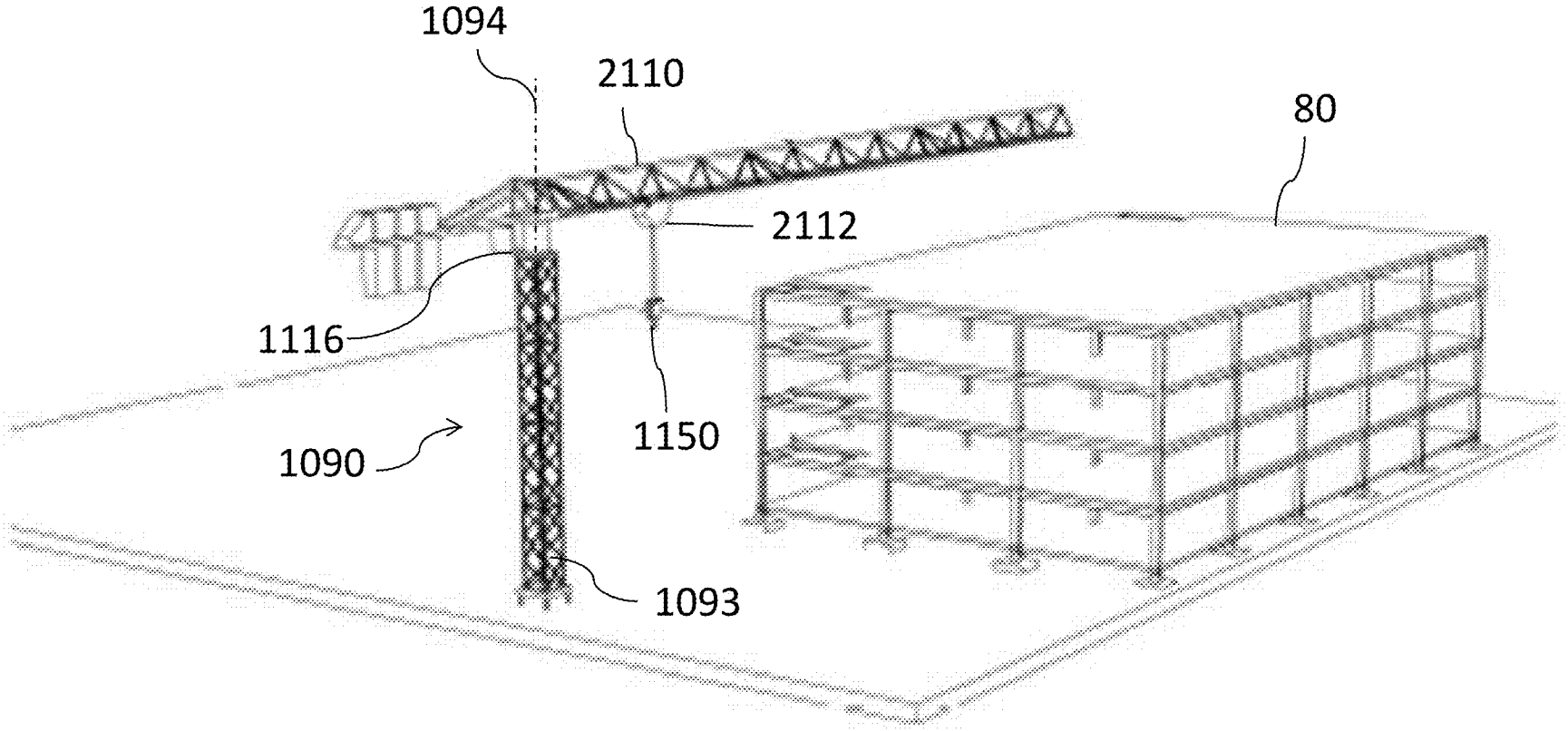
FIG. 14 is a perspective view showing a crane and obstacle at a jobsite, according to an embodiment.

Referring to FIGS. 12 and 13, a method 1500 of setting up the WRL 360 for the tower crane 1090 may be similar to the method 500 described above and shown in FIG. 9. Likewise, a method 1900 for altering tower crane 1090 functions during crane use may be similar to the method 900 described above and shown in FIG. 10. However, it will be appreciated that the methods 1500 and 1900, as they apply to the tower crane 1090, may vary in some aspects from the methods 500 and 900, respectively, due to, for example, different movements of the luffing jib 1110 compared to the telescoping boom 110. In the following description of the methods 1500 and 1900, further description of steps that are the same or substantially the same as the steps described above with respect to the methods 500 and 900, may be omitted.

FIG. 12 is a flow chart showing an example of the method 1500 for setting up the WRL 360 for the tower crane 1090 having a boom, such as the luffing jib 1110. Referring to FIG. 12, in one embodiment, the method 1500 for setting up the WRL 360 for the tower crane 1090 includes: at 1501, initiating the WRL setup; at 1502, determining a front face normal vector; at 1503, determining a boundary of the face; at 1506, determining a remaining boundary of the forbidden volume; and at 1507, completing the WRL setup. These steps correspond to the steps 501, 502, 503, 506, 507, respectively, shown in FIG. 9 and described with respect to the method 500 above. In one embodiment, determining the boundary of the face 1503 may also include: at 1504, determining a top left point; and at 1505, determining a top right point. Steps 1504 and 1505 correspond to steps 504, 505, respectively, shown in FIG. 9 and described with respect to the method 500 above. As noted above, however, it is appreciated the steps in the method 1500 may vary from those in the method 500 above, due to different movements of the luffing jib 1110 of the tower crane 1090, compared to movements of the telescoping boom 110 of the crane 90.

Referring again to FIG. 11, a three-dimensional model of the forbidden volume 400 may correspond, generally, to a shape of an obstacle, such as the building 80. In one embodiment, the forbidden volume 400 is the same as the forbidden volume 400 shown in FIG. 4, and includes the same features of the forbidden volume 400 shown in FIG. 4, although not necessarily labeled in FIG. 11.

Referring still to FIG. 11, the tower mast 1093 is stationary, and thus, is fixed in position relative to the forbidden volume 400. As shown in FIG. 11, the tower crane 1090 may be positioned substantially away from a corner of the forbidden volume 400 or building 80, such that the crane 1090 is not aligned with a vector that extends normal to a face on the forbidden volume 400 or building 80. A front face normal vector 1460 may represent a distance between the mast 1093 and a plane in which a front face of the building 80 or forbidden volume 400 extends, in a direction from the tower mast 1093 to the plane that is normal to face.

Referring to FIG. 12, in block 1502, and with reference to the configuration shown in FIG. 11, the front face normal vector 1460 may be determined using a number of different techniques. For example, the front face normal vector 1460 may be determined by measuring a distance between the mast 1093 and a plane in which the front face of the building 80 or forbidden volume 400 extends, along a direction normal to the plane. The distance may be measured manually or using suitable range finding techniques, such as laser, radar, sonar, ultrasonic and trigonometric range finding techniques, and/or as part of a conventional surveying technique.

Alternatively, or in addition, the front face normal vector 1460 may be determined by measuring a distance between the mast 1093 and a nearest corner of the building 80 or forbidden volume 400. Such a distance may represent a hypotenuse of a right triangle, shown at 1461 in FIG. 11, for example. An angle between the hypotenuse 1461 and a direction normal to the plane or the front face may be determined using known techniques, for example, conventional surveying techniques. In one embodiment, the angle may be determined by aligning the luffing jib 1110 with the hypotenuse 1461 and recording a slew angle, for example, with the RCL 365. Accordingly, with the length of the hypotenuse 1461 known (i.e., a distance between the mast 1093 and the nearest corner of the building 80 or forbidden volume 400), and an angle between the hypotenuse 1461 and the normal direction known, the front face normal vector 1460 and the associated distance may be determined using known trigonometrical techniques. In still another example, the distance between the mast 1093 and either the plane in which the front face of the building 80 or forbidden volume 400 lies, or the nearest corner of the building 80 or forbidden volume 400, may be determined by positioning the hook block 1150 at the plane or nearest corner, and recording, with the RCL 365 for example, a position of the hook block 1150 and optionally, as noted above, the slew angle of the luffing jib 1110 with the hook block 1150 so positioned. It is understood that these examples are not exhaustive, and that other suitable, known techniques may be used to determine the front face normal vector 1460. In one embodiment, the distance, with respect to the tower mast 1093, is measured from or to the vertical axis of rotation 1094.

Using the techniques above for determining the front face normal vector 1460, a vector 1462 representing a distance between the tower mast 1093 and a face of building 80 or forbidden volume 400 adjacent to the front face, may be determined as well. However, it is understood that determining such a vector 1462 is optional and is not required in the methods and systems described herein.

In another embodiment, the tower crane 1090, and in turn, the tower crane mast 1093 may be positioned relative to the forbidden volume 400 or building 80 such that a vector extending normal to a face of the forbidden volume 400 or building 80 will intersect the tower mast 1093. With the tower crane 1090 positioned as such, this normal vector is the front face normal vector 1460, and generally corresponds to the front face normal vector 460 described in the embodiments above. Referring to FIG. 12, in block 1502, the front face normal vector 1460 may be determined with the luffing jib tower crane 1090. The front face normal vector 1460 may be determined, for example, by controlling the rotating bed 1116 to point the luffing jib 1110 toward the forbidden volume 400, recording a swing or slew angle of the luffing jib 1110 in such a position. A magnitude of the front face normal vector 1460 may be created by raising or lowering the luffing jib 1110 to change a horizontal position the hook block 1150 to position the hook block 1150, or in some embodiments, the tip of the luffing jib 1110, at a distance desired for the creating quasi-volume front face 405, and recording the current hook radius (which is a common element measured by a crane control system), for example, with the RCL 365. For this step the hook block 1150 can be at any desired height. The front face normal vector 1460 represents a distance from an origin of the coordinate system, which as described above, may be at a base of, or positioned along, the axis of rotation 1094 of the rotating bed 1116. The distance represented by the front face normal vector 1460 may be constant because, as indicated above, the tower crane mast 1093 is substantially fixed against movement relative to the front face 405.

In block 1503, a boundary of the face 405 may be determined, for example, as described in the embodiments above. In one embodiment, the top left and the top right locations 410, 411 (see FIG. 4) may be determined by pointing the luffing jib 1110 at each location 410, 411 on the actual building object or other obstacle and recording the swing (slew) angle and the lift (luffing) angle. Alternatively, or in addition, the hook block 1150 may be positioned, for example, by controlling movement of crane components, such as the rotating bed 1116, the hoist (not shown) and/or the luffing jib 1110, with the computer device 300, or manually, to position the hook block 1150 at the locations 410, 411. Position information, such as the hook radius, hook height, and/or coordinates in the coordinate system, of the hook block 1150 may be recorded, with the RCL 365 and coordinates of the points 410, 411 may be determined. For other building shapes, other points may be used. Additional position information, including coordinates, defining the boundary of the forbidden volume may be determined by positioning the hook block 1150 at other points and recording the position information of the hook block 1150.

In one embodiment, determining coordinates for the top left point 1504 and top right point 1505 may be performed, as noted above, by recording position information of the hook block 1150 at the top left and top right points, respectively. In another embodiment, determining coordinates of the top left point may include creating a first position vector extending from the origin of the coordinate system (e.g., a point along the axis of rotation 1094) to the top left point 410 identified with the hook block 1150 or end of the luffing jib 1110. A location of the top left point 410 may be determined by intersecting the first position vector and a plane for the front face 402 (see FIG. 4). A location of the top right point 411 may be determined using similar techniques. For example, position information of the hook block 1150 may be recorded when positioned at the top right point 411, or a second position vector may be created that extends from the origin of the coordinate system to the top right point 411, and intersecting the second position vector with a plane of the front face 402. Thus, in one embodiment, locations (or coordinates) of the top left point 410 and the top right point 411 may be determined using processes similar to those described in steps 504 and 505, respectively, with the top left and right points 410, 411 being identified as described above.

Modeling of a front top edge 466 (see FIG. 4) may be carried out in the manner described in the embodiments above. In addition, a direction unit vector for the front top edge and for the normal to the front face 405 may be determined as described in the above embodiments. Further, direction unit vectors for the left edge 467 and right edge 468 (see FIG. 4) may be determined as described in the embodiments above as well.

With further reference to FIG. 12, in block 1506, the remainder of the forbidden volume 400 may be determined. In one embodiment, the remainder of the forbidden volume 400 is determined as described in the embodiments above and shown in FIG. 9. In one embodiment, the forbidden volume 400 may be formed as a prismatic shape, and can be formed after determining the top left point 410 and the top right point 411. It is understood that with respect to the tower crane 1090, a load may be positioned on top of a building or carried beyond the top of the building. Accordingly, in one embodiment, a coordinate of a third point may be identified in a plane different from the front face 405 to provide a depth to the forbidden volume 400. In block 1507 the WRL setup is completed.

FIG. 13 illustrates a flow chart of a method 1900 for altering tower crane functions, i.e., controlling crane component movement, during crane use, according to one embodiment. With the forbidden volume (or quasi-volume) 400 defined within the coordinate system, and a crane component, such as the boom 1110 (including the luffing jib 1110) or hook block 1150, represented as a known vector within the coordinate system, the crane controller 350 may alter crane functions to control movement of the crane component so as to avoid undesirable interactions between the crane component and the obstacle or object 80.

In one embodiment, in block 1901, coordinate data is saved to memory. The coordinate data provides a reference for orientating the tower crane 1090 and its relationship to objects around it, such as the obstacle 80 (e.g. the building) and/or the forbidden volume 400. One example of saving coordinate data includes identifying the location of the crane component, such as a pivot point (e.g., the axis of rotation 1094) of a boom, such as luffing jib 1110, or a location of the hook block 1150, as shown in block 1906. In block 1902, crane component data is saved to memory. In one embodiment, the crane component data may be boom data, represented by luffing jib vector 1169, and/or hook block data represented by hook block model 2169. The component data may represent, for example, a location of a crane component, such as the boom, including the luffing jib 1110, and the hook block 1150.

In one embodiment, the hook block model 2169 may be a 3D model. For example, in an embodiment, the hook block model 2169 may be a circle in a 3D space, disposed substantially in a horizontal plane. The hook block model 2169 may be sized and shaped to be larger than the actual hook block 1150. Accordingly, the hook block model 2169 provides a buffer around the actual hook block 1150 to account for swinging and swaying of the hook block 1150 that may occur in the course of normal use. It is understood, however, that the hook block model 2169 is not limited to the horizontally positioned circle in the 3D space described above. For example, other suitable shapes are envisioned, including, but not limited to, elliptical, square, trapezoidal, cubical and other prisms, cylindrical, conical, spherical, pyramidal, and the like. In one embodiment, the hook block model 2169 may be a shape that substantially corresponds to the actual shape of the hook block 1150. The size, for example, a width or diameter, of the hook block model 2169 may correspond to one or more a predicted or detected range of motion of a swinging or swaying hook block 1150, such that swinging or swaying motion of the hook block 1150 is within or substantially within the hook block model 2169. In one embodiment, the modeled hook block 2169 may be sized to include a load coupled to the hook block 1150.

The luffing jib vector 1169 and/or the hook block model 2169 may be determined automatically by the computer system 300 and may be line segments or other shapes disposed in a 3D environment. The luffing jib vector 1169 may be used to model the luffing jib 1110. In block 1903, obstacle data is saved to memory. The obstacle data may be saved to memory using the method 1500 shown in FIG. 12, for example. In some embodiments, a building information model (BIM) may be loaded into memory as shown in block 1907.

The luffing jib vector 1169 and hook block model 2169 data may be saved to memory during operation of the tower crane 1090. The distance from the luffing jib 1110 and/or the hook block 1150 to the quasi-volume features (such as faces and edges of forbidden volume 400) may be computed in block 1904 based on the boom data and/or hook block data and the obstacle data (e.g., the forbidden volume 400). In one embodiment, a direction unit vector may be computed using the luffing jib vector 1169 or hook block model 2169 in the manner described in the embodiments above and discussed with reference to FIG. 10. These direction unit vectors represent distances that are the basis for a boom proximity vector 1473 and a hook block proximity vector 2473 (see FIG. 11). The boom proximity vector 1473 represents a minimum distance between a point on the luffing jib 1110 or luffing jib vector 1169 and the forbidden volume 400 and the hook block proximity vector 2473 represents a minimum distance between a point on the hook block 1150 or hook block model 2169 and the forbidden volume 400.

Referring again to FIG. 11, with the luffing boom 1110 modeled as the luffing jib vector 1169 and the hook block 1150 modeled as the hook block model 2169, vectors may be computed for tower crane function motions. Such motions include, for example, the swing-left and swing-right motions 1470 and boom-up and boom-down motions 1472. A hook-down motion may also be computed. The hook-down motion is in the same direction as the boom-down motion, shown by 1472.

For each motion there is a direction which may be represented by unit vectors within the coordinate system as follows: swing-left, swing-right, boom-up, boom-down and hook-down. Calculation of these unit vectors may be carried out substantially the same as described above with reference to the boom 110 and FIG. 10. It is understood, however, that the unit vectors associated with the luffing jib 1110 may be different from the unit vectors associated with the telescoping boom 110 in that the luffing jib 1110 may optionally omit unit vectors associated with telescoping movement.

In one embodiment, the boom proximity vector 1473 starts at the nearest point on the luffing jib 1110 to the forbidden volume 400, and this point may be along the length of the luffing jib 1110 (and not necessarily at the end of the luffing jib). The boom proximity vector 1473 may be converted to a direction unit vector as described in the embodiments above with respect to the critical proximity vector 473. Alternatively, or in addition, the computer system 300 may convert the hook block proximity vector 2473 to a direction unit vector using techniques similar to those in the embodiments above, but taking into account the motions of the hook block 1150.

Referring again to FIG. 13, in block 1905, a scale factor for each crane function may be determined for alterations of the control system, and subsequently, crane functions or operations. In one embodiment, the scale factors are similar to those described in the embodiments above. It is understood, however, that scale factors relating to telescoping movement may be omitted with respect to the luffing jib 1110 of the tower crane 1090.

Figure 7:
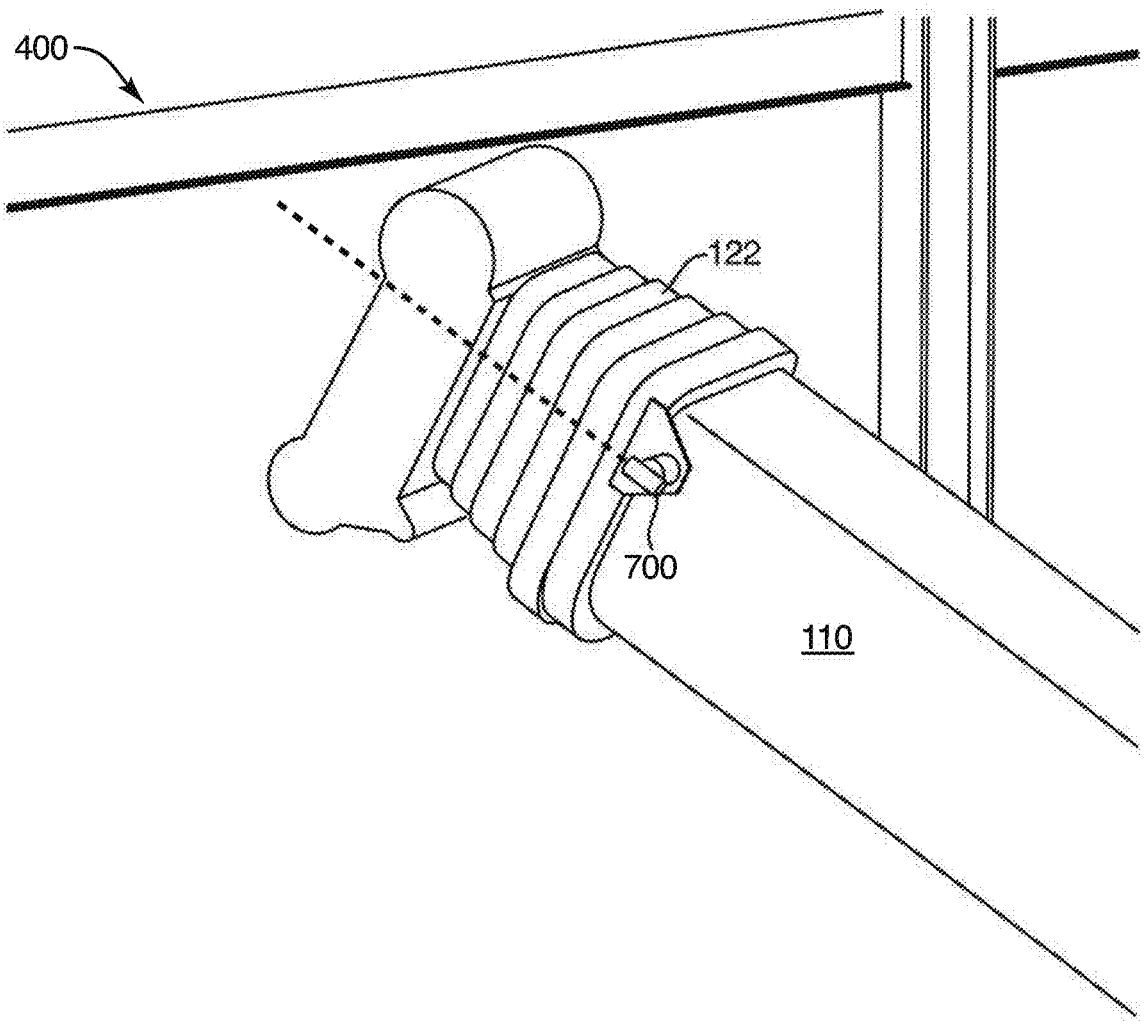
FIG. 7 is a perspective view of a boom having an electronic assist device for aiming the boom.

In one embodiment, positioning of the luffing jib 1110 or hook block 1150 may be enhanced by manual or electronic assistance as described in the embodiments above, and shown, for example, in FIGS. 6 and 7.

According to one embodiment, when the proximity distance (i.e., the distance associated with boom proximity vector 1473 or hook block proximity vector 2473) reaches a slowdown threshold distance, the crane function will begin to slow down. For example, the rotating bed 116 may be controlled such that movement of the luffing jib 1110 and hook block 1150 may be slowed in a swinging direction, a lift actuator (not shown) may be controlled such that movement of the luffing jib 1110 and/or hook block 1150 may be slowed in a lifting direction, or the hoist may be controlled such that movement of the hook block 1150 in a vertical direction may be slowed. When the proximity distance reaches a shutdown threshold, the crane function will stop. For example, movement of the luffing jib 1110 or the hook block 1150 may be stopped, by controlling the rotating bed 1116, lifting actuator and/or the hoist. In addition, further operation of the luffing jib 1110 and/or hook block 1150 may be locked out. These thresholds may be universal for the crane (applied to all crane functions), or the thresholds may be specific to each function.

The degree to which each tower crane function may require alteration within the threshold zone may be based on the position of the luffing jib 1110. In one embodiment, the degree of alteration may be based on taking the dot product of the boom proximity unit vector and the earlier computed tower crane motion direction unit vectors. For example, if the luffing jib 1110 is swinging left toward a wall on the left, the boom proximity vector 1473 will be pointing to the left (from the job to the wall), and the swing-left motion vector will likewise be pointing to the left. The dot product in this case will be relatively close to 1, and would indicate that the swing-left function should be directly altered. However, the swing-right direction will be a unit vector pointing to the right; and the dot product in this case (still with respect to the critical proximity vector pointing to the left) will be relatively close to −1. Crane function alteration factors may be computed in substantially the same manner as described above and the process of determining crane function scale factors may be substantially the same as described above. The degree of alteration of the hook block 1150 motion may be similarly determined.

While the embodiments above, described with reference to the luffing jib 1110 and FIGS. 11-13, provide that various calculations, determinations, and the like, may be carried out while omitting information relating to telescoping movements, the present disclosure is not limited thereto. For example, with respect the luffing jib 1110, movement in a telescoping direction may be considered to be fixed or held constant in such calculations, determinations, and the like.

FIGS. 14-18 show a tower crane 1090 according to another embodiment. For example, in one embodiment, the boom 2110 of the tower crane 1090 may be in the form of a hammerhead jib 2110. The tower crane 1090 may also include a trolley 2112. The trolley 2112 is movable along a length of the hammerhead jib 2110 toward and away from the crane mast 1093. The hook block 1150 is connected to the trolley 2112 and hammerhead jib 2110 by way of a flexible member, such as a rope. The hook block 1150 is configured for selective engagement and disengagement from a load (not shown) for lifting and lowering of the load in response to winding and unwinding of the rope, and/or to transporting the load in a substantially horizontal direction in response to movement of the trolley 2112 along the hammerhead jib 2110.

According to one embodiment, a coordinate system may have an origin at a base of the axis of rotation 1094 of the rotating bed 1116. In one embodiment, the coordinate system is the same as the coordinate system 98 described in the embodiments above, but has an origin that is positioned relative to the tower crane 1090. For example, in one embodiment, the coordinate system may be fixed relative to the lower works 1093, i.e., the tower crane mast, of the tower crane 1090. However, in other embodiments the coordinate system could be fixed relative to the rotating bed 1116 such that the X axis would remain constant along the hammerhead jib 2110. Other coordinate systems are possible and could be based on any origin within the construction zone. In one embodiment, coordinate data stored in the memory includes the axis of rotation 1094 of a boom, such as the hammerhead jib 2110.

Movements of the hammerhead jib 2110 include swinging, or slewing, movements in response to the rotating bed 1116 being controlled to move. Movements of the hook block 1150 and trolley 2112 may be controlled as well. Such movements include substantially horizontal, or radial, movement caused by the moving the trolley 2112 along the hammerhead jib 2110 toward and away from the tower mast 1093, and swinging movement together with the hammerhead jib 2110, in response to the rotating bed 1116 being controlled to move. In one embodiment, a trolley motor (not shown) is configured to drive the trolley 2112 along the hammerhead jib 2110. As described above, such control of movements may include, for example, starting and stopping movement, controlling speed of the movement by increasing or decreasing speed of the crane component (e.g., the hammerhead jib 2110, the trolley 2112, the hook block 1150), and/or preventing operation or movement of the crane component.

In one embodiment, the crane component movements may be controlled by the computer system 300, for example, the crane controller 350. For example, the computer system 300 may be operably connected to an actuator to control movement of the rotating bed 1116, and consequently, control swinging movement of the hammerhead jib 2110, trolley 2112 and hook block 1150. The computer system 300 may also be operably connected to the trolley motor to cause movement of the trolley 2112 and the hook block 1150 along the hammerhead jib 2110. The computer system 300 may also be connected to the hoist to control raising and lowering of the hook block 1150. Thus, the hammerhead jib 2110, trolley 2112 and the hook block 1150 are configured for swing-left and swing-right movements. The trolley 2112 and the hook block 1150 are configured for trolley-in and trolley-out movements along the hammerhead jib 2110, and the hook block 1150 is configured for hook-up and hook-down movements, in response to hoist-in and hoist-out movements.

A hook radius may be changed, for example, by moving the trolley 2112 along the hammerhead jib 2110, i.e., by way of the trolley-in and trolley-out movements. The horizontal position of the hook block 1150 may be measured, for example, relative to the tower mast 1093, vertical axis of rotation 1094, or from a reference point along the hammerhead jib 2110.

Figure 15:
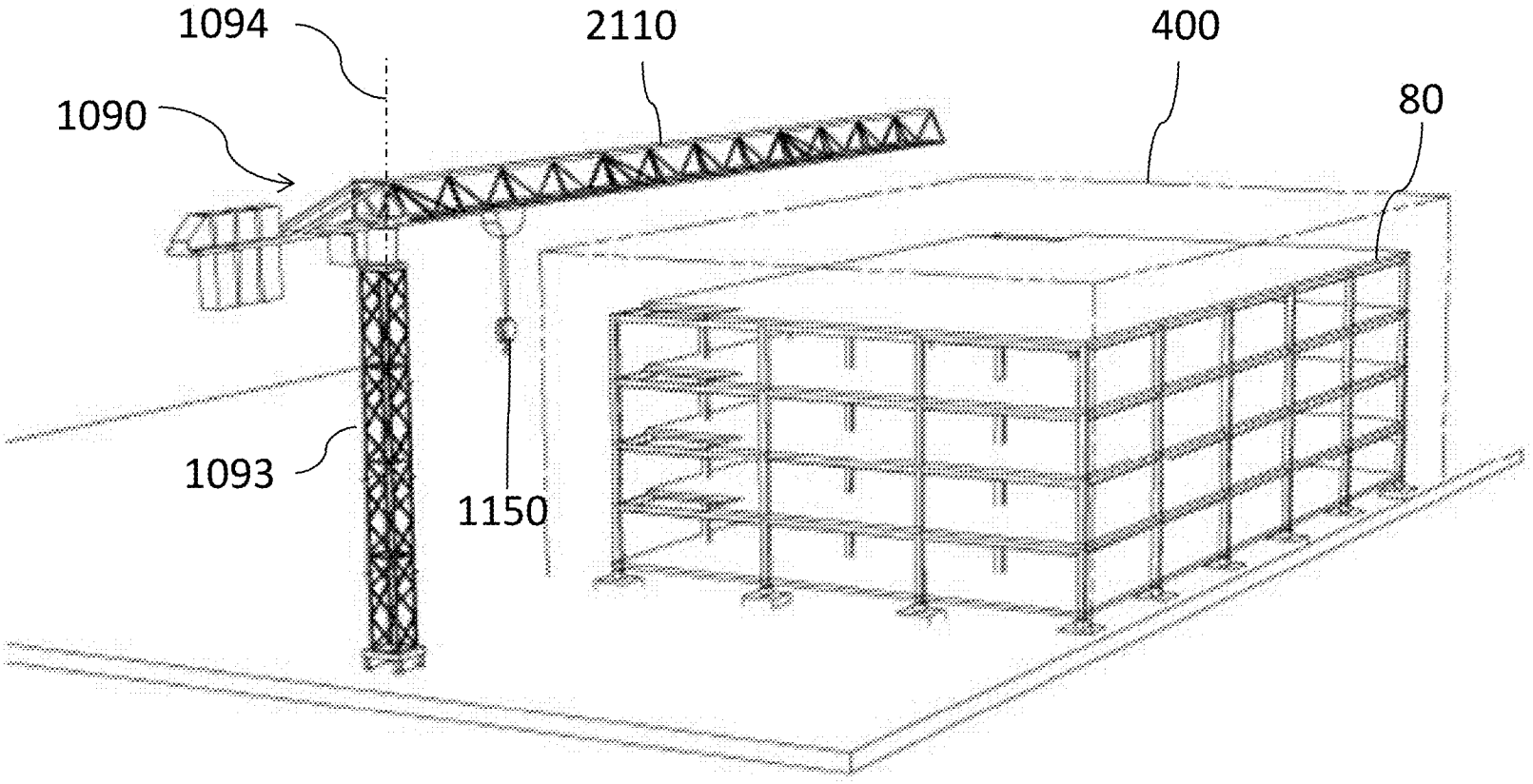
FIG. 15 is a perspective view showing a crane positioned relative to an obstacle and a forbidden volume at a jobsite, according to an embodiment.

FIG. 15 is a perspective view showing the tower crane 1090 positioned relative to the building 80 and the three dimensional ("3D") forbidden volume 400 defined around the building 80. The forbidden volume 400 may be the same or substantially the same as the forbidden volume described in the embodiments above, and shown, for example, in FIGS. 4 and 11. In one embodiment, the forbidden volume 400 defines a space or zone where it is desirable to prevent crane components, such as the hammerhead jib 2110, hook block 1150, and/or the trolley 2112, from entering. In one embodiment, the forbidden volume 400 may generally correspond in shape to the obstacle 80. The forbidden volume 400 may also include a buffer, such that the forbidden volume 400 is larger than a volume of the obstacle 80. In one embodiment, obstacle data stored in the memory includes the forbidden volume 400.

During normal operation of the tower crane 1090, the hammerhead jib 2110 would not enter the forbidden volume 400 because the hammerhead jib 2110 is positioned above the forbidden volume 400. However, it remains possible for the hook block 1150, disposed below the hammerhead jib 2110, to enter the forbidden volume 400 in response to movement of the trolley 2112 along the hammerhead jib 2110 toward the forbidden volume 400, or in response to unwinding of the rope from a hoist (not shown) to lower the hook block 1150, i.e., the hook-down movement.

Figure 16:
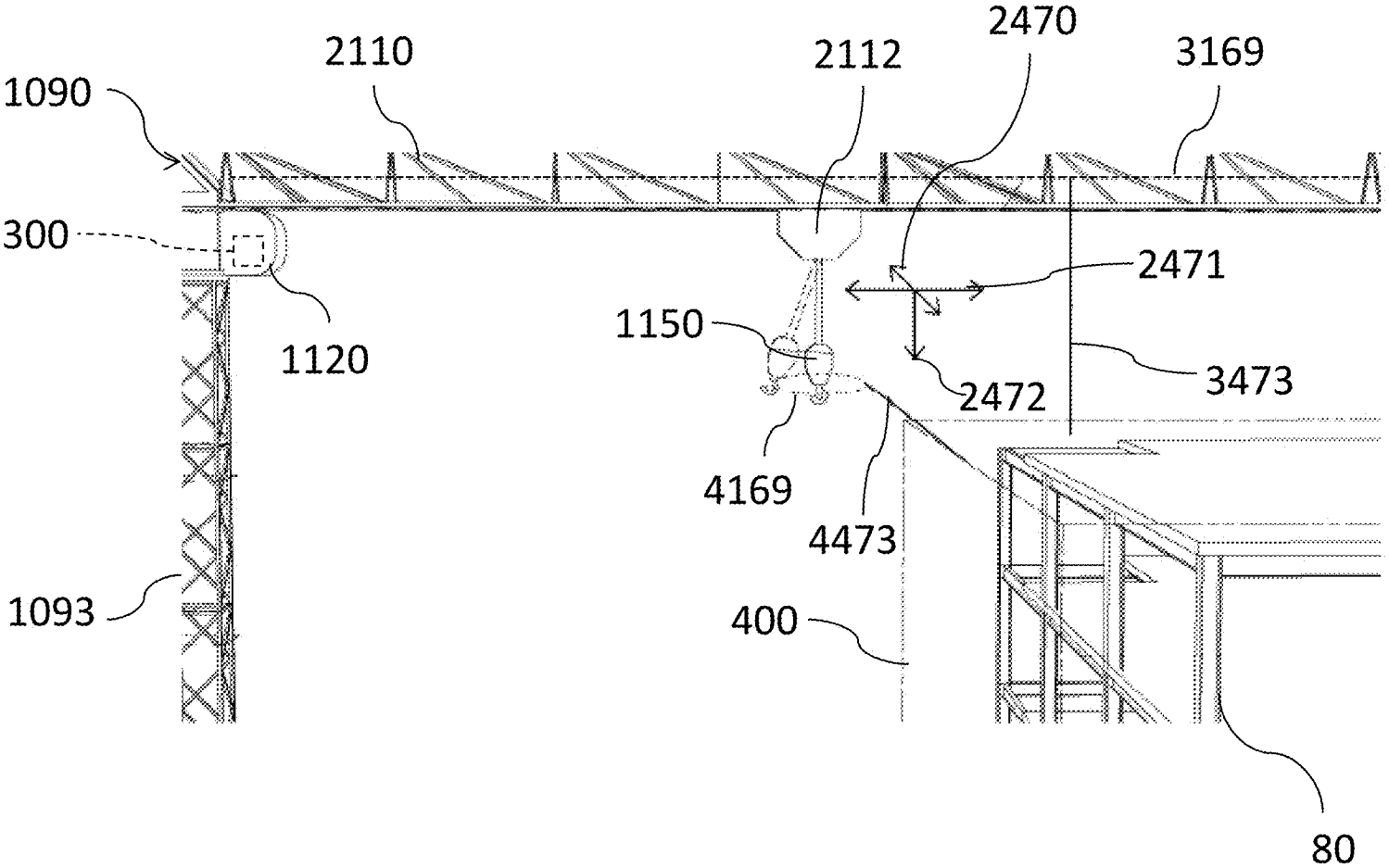
FIG. 16 is shows examples of modeled component of a crane, according to an embodiment.

FIG. 16 shows an example of a 3D modeling of the crane 1090 relative to the obstacle 80 and forbidden volume 400, according to an embodiment. In one embodiment, the hammerhead jib 2110 may be modeled as a line segment or vector 3169 (also referred to herein as the "hammerhead jib vector 3169") extending in a 3D environment. In addition, the hook block 1150 may be modeled as a 3D hook block model 4169. For example, in an embodiment, the hook block model 4169 may be a circle in a 3D space, disposed substantially in a horizontal plane. The hook block model 4169 may be sized and shaped to be larger than the actual hook block 1150. Accordingly, the hook block model 4169 provides a buffer around the actual hook block 1150 to account for swinging and swaying of the hook block 1150 that may occur in the course of normal use. It is understood, however, that the hook block model 4169 is not limited to the horizontally positioned circle in the 3D space described above. For example, other suitable shapes are envisioned, including, but not limited to, elliptical, square, trapezoidal, cubical and other prisms, cylindrical, conical, spherical, pyramidal, and the like. In one embodiment, the hook block model 4169 may be a shape that substantially corresponds to the actual shape of the hook block 1150 The size, for example, a width or diameter, of the hook block model 4169 may correspond to one or more of a predicted or detected range of motion of a swinging or swaying hook block 1150, such that swinging or swaying motion of the hook block 1150 is within or substantially within the hook block model 4169. In one embodiment, the hook block model 4169 may be sized to include a load coupled to the hook block 1150. Crane component data stored in the memory may include boom data, represented by the hammerhead jib vector 3169, and/or hook block data represented by the hook block model 4169. The hammerhead jib vector 3169 and hook block model 4169 include data representing the location of the boom, for example the hammerhead jib 2110, and hook block 1150, respectively.

With further reference to FIG. 16, the computer system 300 may determine a hook block proximity vector 4473, represented as a line segment in a 3D environment, to represent a minimum distance of the hook block 1150 or modeled hook block 4169 to one of, or both, the obstacle 80 and the forbidden volume 400. The computer system 300 may also determine a boom proximity vector 3473, represented as a line segment in a 3D environment, to represent a minimum distance of the hammerhead jib 2110 or modeled hammerhead jib 3169 to one of, or both, the obstacle 80 and the forbidden volume 400.

The hook block and boom proximity vectors 4473, 3473 may be determined in a manner similar to the proximity vector 473, hook block proximity vector 2473 and boom proximity vector 1473 described in the embodiments above.

Still referring to FIG. 16, five vectors are shown representing possible movements of the hook block 1150. A first motion is the horizontal motion 2471 in response to trolley-in and trolley-out movements of the trolley 2112 along the hammerhead jib 2110, the second motion is the slewing motion 2470 in response to swing-left and swing-right motion of the hammerhead jib 2110, and the third motion is a vertical motion 2472, in response to lowering the hook block 1150, i.e., hook-down or hoist-out movement. Although upward vertical movement, i.e., hook-up or hoist-in movement, of the hook block 1150 may be considered as well, such consideration is not necessary, because such upward movement typically will not move the hook block 1150 toward a forbidden volume 400. Hammerhead jib 2110 movements may be limited to the slewing motion 2470. However, a vertical component may be considered as well to determine the proximity to an obstacle 80 or forbidden volume 400 positioned below the hammerhead jib 2110.

For each motion there is a direction, and the directions are represented by five unit vectors within the coordinate system as follows: trolley-out, trolley-in, swing-left, swing-right, and hook-down. Unit vectors for each motion may be calculated similar to the unit vectors described above with respect to motions 470, 471, 472, 1470 and 1472, as appropriate. However, it is understood that the calculations may be adjusted to account for the different movements carried out by the tower crane 1090, described above. In addition, the hook block and boom proximity vectors 4473, 3473 may be converted to respective direction unit vectors in a manner similar to that of the critical proximity vector 473, boom proximity vector 1473 and hook block proximity vector 2473 in the embodiments above. The dot products of the hook block proximity vector 4473 and the motion vectors 2470, 2471, 2472, as applicable, and/or the dot products of the boom proximity vector 3473 and the motion vectors 2470, 2471, 2472, as applicable, may provide a basis for controlling or preventing crane functions.

Control or prevention of crane functions and movements may be carried out as described in the embodiments above. For example, a threshold distance may be established between the crane component and the forbidden volume 400 and a crane function may be changed or stopped based on a computed minimum distance between the crane component and the forbidden volume being equal to or less than the established threshold distance. In one embodiment, the established threshold distance may be a slowdown threshold distance, whereby a movement of the crane component or crane function is slowed in response to the computed minimum distance being equal to or less than the slowdown threshold distance. Alternatively, or in addition, the threshold distance may include a shutdown threshold distance, whereby movement of the crane component or crane function is stopped in response to the computed minimum distance being equal to or less than the shutdown threshold distance.

Figure 17:
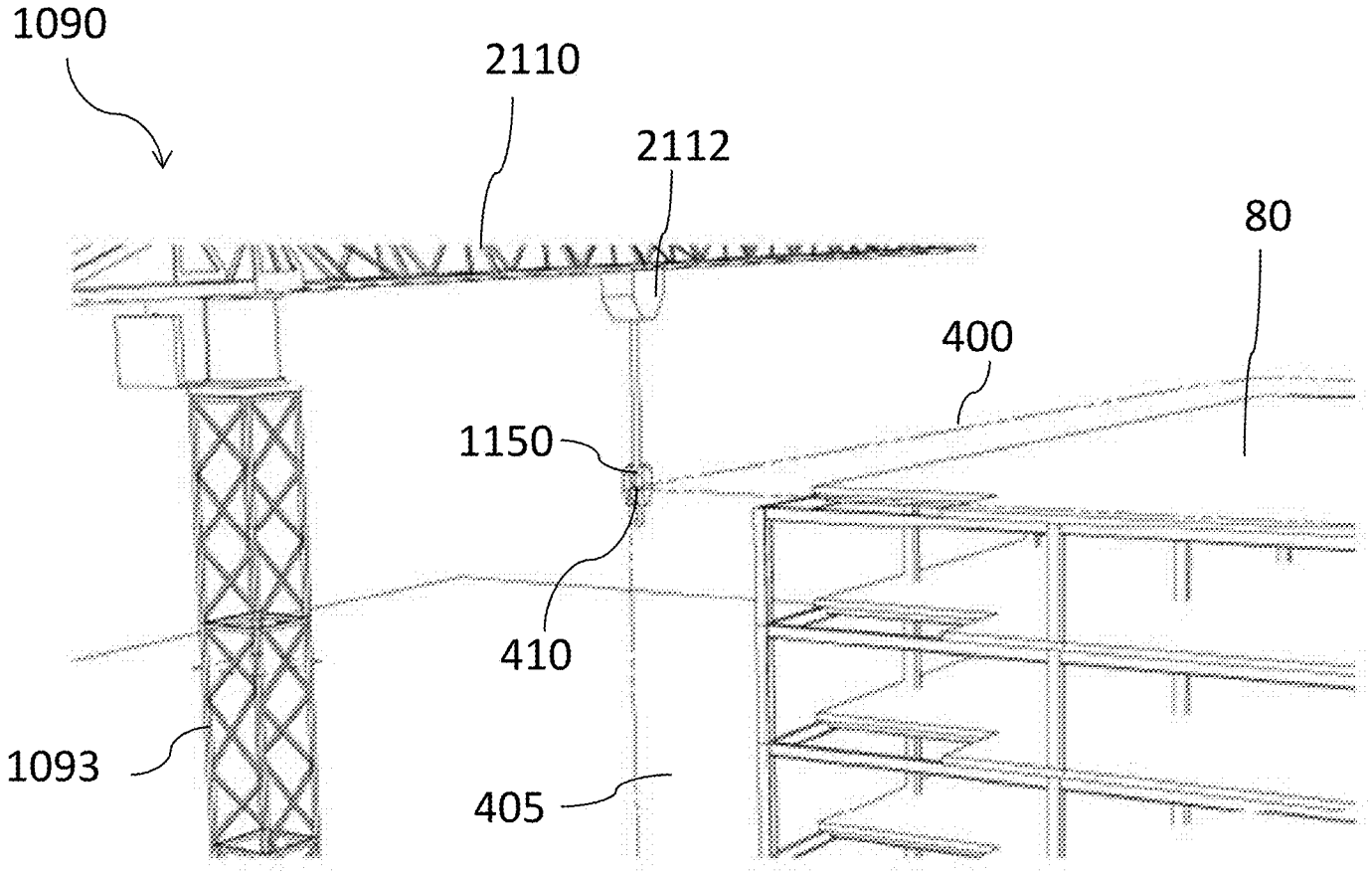
FIG. 17 is a perspective view showing an example of a crane identifying a point relative to an obstacle, according to an embodiment.
Figure 18:
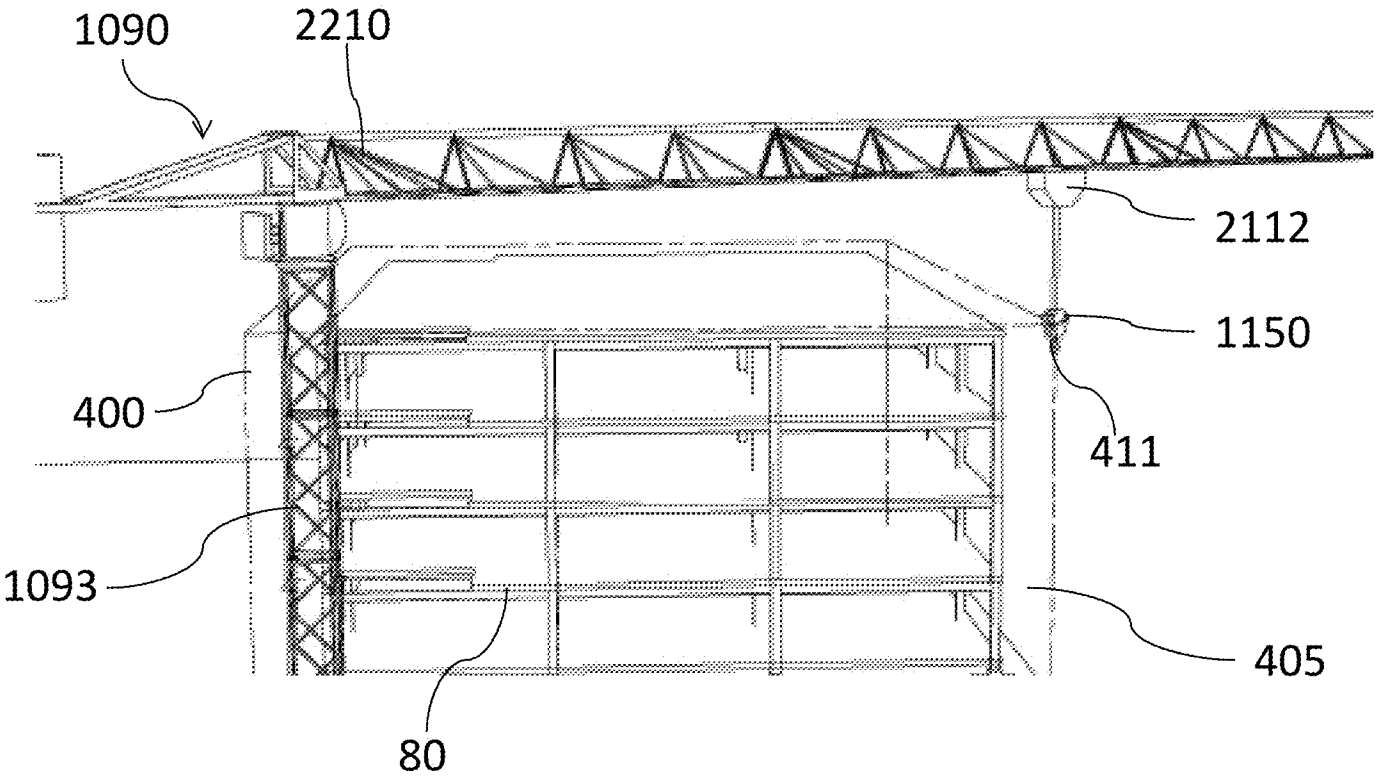
FIG. 18 is a perspective view showing an example of a crane identifying another point relative to an obstacle, according to an embodiment.

FIGS. 17 and 18 are perspective views illustrating operation of the tower crane 1090 to tag points for determining or identifying locations on the obstacle 80 or forbidden volume 400, according to an embodiment described herein. For example, FIG. 17 shows an upper-left point 410 of a face 405 of the forbidden volume 400 being tagged, or identified, by positioning the hook block 1150 at the upper-left point 410. In one embodiment, a position of the hook block 1150 may be recorded at the point 410 by the RCL 365. Similarly, FIG. 18 shows an upper-right point 411 of the face 405 of the forbidden volume 400 being tagged, or identified, by positioning the hook block 1150 at the upper-right point 411. In one embodiment, a position of the hook block 1150 may be recorded at the point 411 by the RCL 365. In one embodiment, the location of the points may be identified as coordinates within the coordinate system.

In one embodiment, identifying the two points 410, 411, is sufficient to create the forbidden volume, for example, by the computer system 300. For example, when the forbidden volume 400 is prismatic, the height information associated with each point 410, 411, and distance information between the points 410, 411, are sufficient to generate the forbidden volume 400.

In one embodiment, one or more cameras may be connected to the trolley 2112 to view the hook block 1150. The one or more cameras may be used to guide the hook block 1150 to the points 410, 411, which may be used to define the forbidden volume 400. The hook block 1150 may be guided to the points 410, 411, for example, by controlling, with the computer system 300, or manually, swinging motion of the hammerhead jib 2110, motion of the trolley 2112 along the hammerhead jib 2110 and operation of the hoist to raise or lower the hook block 1150.

Alternatively, or in addition, a range finding system, such a laser-type system, may be connected to the tower crane 1090, for example, at the trolley 2112. In one embodiment, the crane operator may move the hook block 1150 directly over the obstacle 80 and use the range finding system to set a proper vertical distance for a buffer above the obstacle 80. The buffer may then be used when generating the forbidden volume 400. In addition, if a dimension or shape of the obstacle is changing with time, for example, as it is being constructed, the tagging and range-finding methods above may be used update the obstacle 80 or forbidden volume 400 stored in the memory.

Accordingly, in the embodiments described above and shown in FIGS. 14-18, for example, the hook block 1150, a position of the hook block 1150 in a 3D coordinate system, and movements of the hook block 1150 may be modeled to generate the hook block proximity vector 4473 between the hook block model 4169 and the obstacle 80 or forbidden volume 400. The hook block proximity vector 4473 may represent a minimum distance between a point on the hook block model 4169 or hook block 1150 and the obstacle 80 or forbidden volume 400 in a 3D environment. In addition, the hammerhead jib 2110 may be modeled as the hammerhead jib vector 3169. Together with a hammerhead jib position and hammerhead jib movements, the boom proximity vector 3473 may be generated between the boom vector 3169 and the obstacle 80 or forbidden volume 400. The boom proximity vector 3473 may represent a minimum distance between a point on the hammerhead jib 2110 or hammerhead jib vector 3169 and the obstacle 80 or forbidden volume 400 in a 3D environment.

The computer system 300 may control crane functions, including movement of crane components, based on a comparison of one or more of the boom proximity vector 3473 and the hook block proximity vector 4473 to an established threshold distance, such as a slowdown threshold distance or a shutdown threshold distance. Such crane functions may include, for example, swing-left and swing-right movements of the hammerhead jib 2110 and hook block 1150, trolley-in and trolley-out movements of the trolley 2112 and hook block 1150 along the hammerhead jib 2110, and/or hook-down movements of the hook block 1150 via hoist operation, to avoid the hammerhead jib 2110 or hook block 1150 from entering the forbidden volume 400 and/or coming into contact with the obstacle 80.

Accordingly, in the embodiments above, a customer may define a 3D forbidden volume around an obstacle, such as a building, and a crane operator may be guided to control or restrict crane functions based on the first and/or second proximity vectors. Alternatively, or in addition, the computer system 300 may control or restrict crane functions based on the first and/or second proximity vectors.

Figure 19:
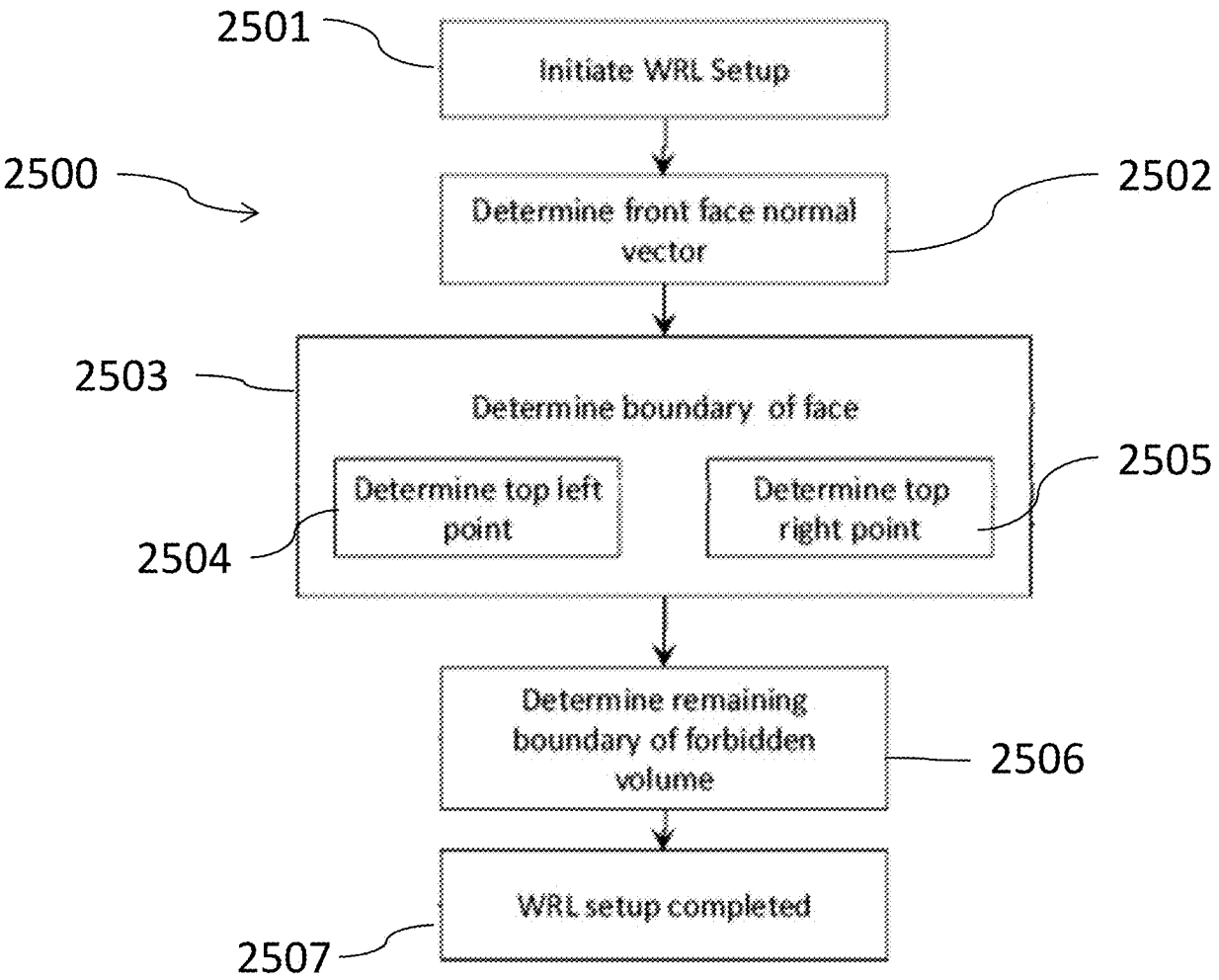
FIG. 19 is a flow chart of a method for setting up a crane control system, according to an embodiment.
Figure 20:
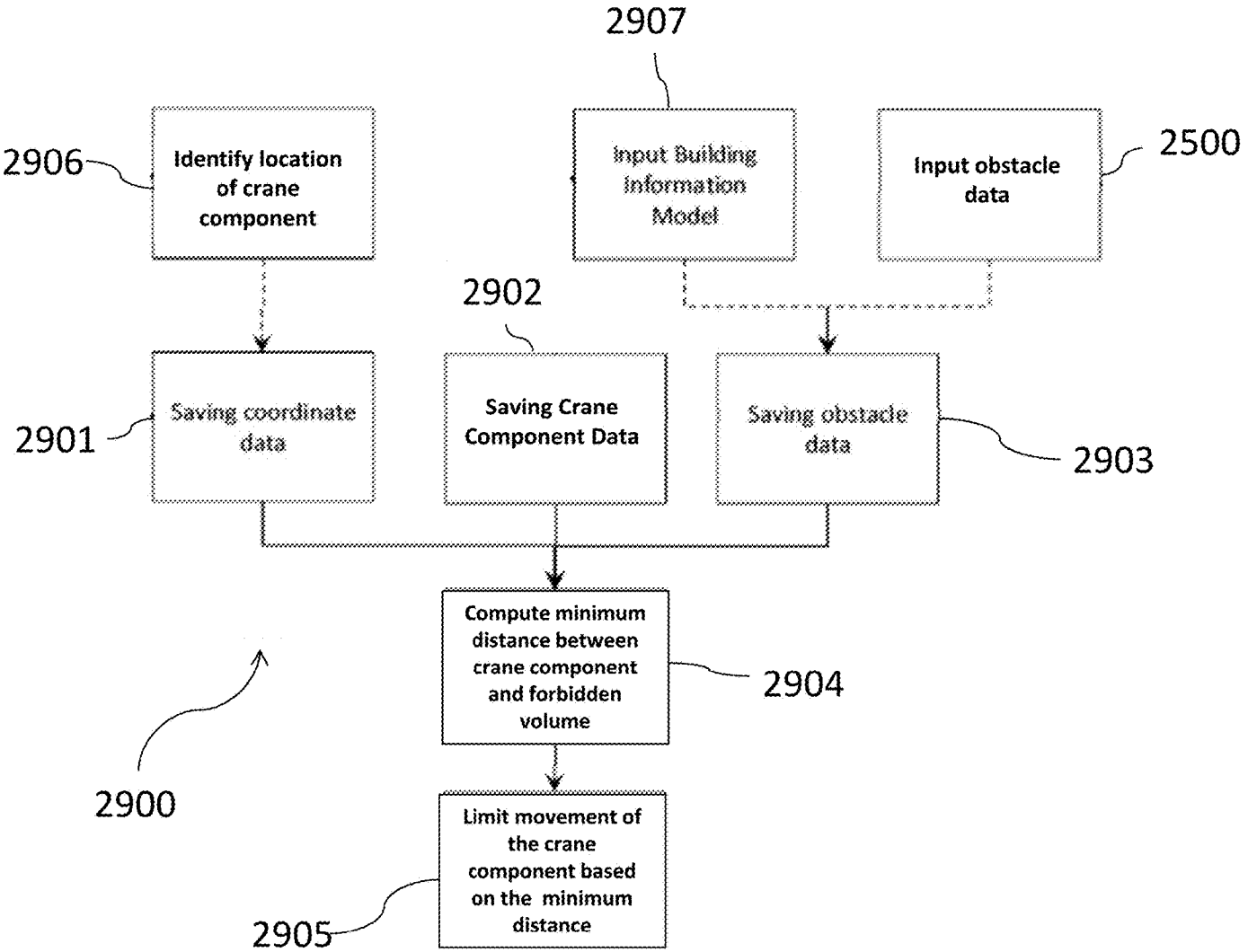
FIG. 20 is a flow chart of a method for limiting the operation of a crane component, according to an embodiment.

Referring to FIGS. 19 and 20, a method 2500 of setting up a WRL for the tower crane 1090 may be similar to the methods 1500 described above and shown in FIG. 12. Likewise, a method 2900 for altering tower crane 1090 functions during crane use may similar to the method 1900 described above and shown in FIG. 13. However, it will be appreciated that the methods 2500 and 2900, as they apply to the tower crane 1090 having the hammerhead jib 2110, may vary in some aspects from the methods 1500 and 1900, respectively, due to, for example, different movements of the hammerhead jib 2110 and hook block 1150 connected the hammerhead jib 2110, compared to the luffing jib 1110 and the hook block 1150 connected to the luffing jib 1110. In the following description of the methods 2500 and 2900, further description of steps that are the same or substantially the same as the steps described above with respect to the methods 1500 and 1900, may be omitted.

FIG. 19 is a flow chart showing an example of the method 2500 for setting up a WRL for the tower crane 1090 having the boom 2110. In one embodiment, the steps 2501, 2502, 2503, 2504, 2505, 2506 and 2507 of the method 2500 correspond the steps 1501, 1502, 1503, 1504, 1505, 1506 and 1507, respectively, of the method 1500 described above and shown in FIG. 12. However, as noted above, the method 2500 may differ from the method 1500 based on different movements of the hammerhead jib 2110 as compared to the luffing jib 1110.

For example, in step 2503, the hook block 1150 may be positioned by controlling movement of crane components, such as the rotating bed 1116, the hoist (not shown) and/or the hammerhead jib 2110, with the computer device 300, or manually, to position the hook block 1150 at the locations 410, 411, as shown in FIGS. 17 and 18. Position information, such as the hook radius, hook height or coordinates within the coordinate system, of the hook block 1150 may be recorded, for example, with the RCL 365. In one embodiment, the position information recorded by the RCL 365 may be converted into coordinates within the coordinate system by the computer system 300.

Thus, in steps 2504 and 2505, locations, or coordinate information, of the top left 410 and the top right 411 points, as shown in FIGS. 17 and 18, may be determined by positioning the hook block 1150 at the top left and right points 410, 411, rather than aiming the hammerhead jib 2110 at the top left and right points 410, 411. In step 2506, remaining boundaries of the forbidden volume 400 may be determined, for example, based on the top left and right points 410, 411, where the forbidden volume 400 is prismatic.

FIG. 20 illustrates a flow chart of a method 2900 for altering tower crane functions during crane use, according to one embodiment. With the forbidden volume (or quasi-volume) 400 defined within the coordinate system, the hammerhead jib 2110 represented as the hammerhead jib vector 3169 and the hook block represented as the hook block model 4169 within the coordinate system, the systems described herein may provide appropriate alterations of the crane control system (for example, via the computer system 300) to avoid undesirable interactions between the hammerhead jib 2110 and/or hook block 1150 and the obstacle or object 80. For example, a minimum distance may be computed between the hammerhead jib 2110 and the forbidden volume, and/or the hook block 1150 and the forbidden volume 400, based on an analysis of the forbidden volume, hammerhead jib vector 3169 and hook block model 4169. The minimum distance between the hammerhead jib 2110 and/or hook block 1150 and the forbidden volume may be compared to an established threshold distance, such as a slowdown threshold distance or a shutdown threshold distance. Crane functions may be altered, for example, by controlling movement of crane components in response to the comparison threshold distances to the minimum distances between the crane components to the forbidden volume.

In some embodiments, the computer system 300 may calculate a maximum swing angle of the boom in each direction, a maximum boom-up angle and a maximum boom-down angle. The computer system 300 may also calculate a maximum hook down and hook up extent. Further, the computer system 300 may calculate a maximum trolley-out extent and a maximum trolley-on extent. In some embodiments, distances between various crane components and, for example, the obstacle 80 or forbidden volume 400, may be measured using conventional distance measuring techniques.

In the embodiments described above, the tower crane 1090 may be, for example, a hammerhead jib tower crane or a luffing jib tower crane. In one embodiment, the tower crane 1090 may be a self-erecting crane. In other embodiments, the systems described herein may be used in conjunction with a crawler crane having a lattice boom. For example, a hook block vector, hook block proximity vector, and minimum distance between a hook block and a forbidden volume may be provided for hook blocks used with mobile cranes, crawler cranes, industrial cranes and the like.

In the embodiments above, the computer system 300 is illustrated generally as being positioned in the operator cab 120, 1120. For example, as shown in FIG. 6, the computer system 300 is schematically represented behind the video display 171 in the operator cab 120, and in FIG. 16, the computer system 300 is schematically represented at the operator cab 1120. In one embodiment, the video display 171 and the display 370 of the computer system 300 may be integrated as a single display. It will be appreciated by those having skill in the art, however, that the computer system 300 is not limited to positioning only in the operator cab 120, 1120. For example, the computer system 300 may have a distributed configuration with different components installed or positioned at various locations on the crane 90, 1090, and/or remote from the crane 90, 1090, with the different components being operably connected to one another by way of known interfaces. Thus, the depictions of the computer system 300 at or in the operator cab 120, 1120 illustrate only one non-limiting example of the how the computer system 300 may be implemented with a crane 90, 1090.

It is understood that various features from the embodiments above may be used together with, or replace certain features, from the other embodiments described above. That is, various features described with respect to one embodiment above, may be used together with or implemented in the other embodiments above.

It should be understood that various changes and modifications to the presently preferred embodiments described herein will be apparent to those skilled in the art. For example, the obstacles can be of any kind, not just rectangular or related to a structure under construction. For example, the forbidden volume could contain a power line as a natural obstacle for which the computer system 300 may monitor and with which to avoid interference, all the while avoiding collision with the forbidden volume. Such changes and modifications can be made without departing from the spirit and scope of the present embodiments and without diminishing its intended advantages. It is therefore intended that such changes and modifications be covered by the appended claims.

The invention claimed is:

1. A method for controlling a crane component of a tower crane in proximity of obstacles at a worksite, the tower crane comprising a mast, a rotating bed coupled to the mast, a boom mounted on the rotating bed, and a hook block connected to the boom, the method executable by a computing device having a processor and memory, comprising:

saving, in the memory, coordinate data representing a coordinate system at the worksite having an origin at a base of an axis of rotation of the rotating bed and fixed relative to the mast, wherein the boom is rotatable on the axis of rotation;

saving, in the memory, obstacle data representing a forbidden volume in the coordinate system;

saving, in the memory, crane component data representing the location of the crane component; and limiting movement of the crane component, by the computing device, to avoid the crane component entering the forbidden volume, wherein the crane component to be controlled is the hook block;

wherein the crane component data includes hook block data represented by a hook block model in the coordinate system to model the hook block, the method further comprising:

determining, by the computing device, a hook block proximity vector using the coordinate data, the obstacle data and the crane component data, the hook block proximity vector representing a minimum distance between a point on the hook block model and the forbidden volume, and limiting movement of the crane component comprises limiting movement of the hook block based on the hook block proximity vector and a threshold distance.

2. The method of claim 1, wherein the saving coordinate data comprises saving data representing the axis of rotation.

3. The method of claim 1, wherein the saving obstacle data comprises inputting data representing the forbidden volume.

4. The method of claim 3, wherein the data representing the forbidden volume includes coordinates of at least two points of the forbidden volume.

5. The method of claim 4, wherein the forbidden volume is a rectangular prism and the at least two coordinates comprise the front, top left corner of the forbidden volume and the front, top right corner of the forbidden volume.

6. The method of claim 4, wherein the coordinates of the least two points of the forbidden volume are identified by positioning the hook block at the at least two points and recording the position of the hook block with a rated capacity limiter (RCL).

7. The method of claim 4, wherein the coordinates of the at least two points of the forbidden volume are identified by using the boom.

8. The method of claim 7, wherein using the boom to identify the at least two coordinates of the forbidden volume comprises:

aiming the boom in a first direction at a front face of the forbidden volume and determining a horizontal distance between the face and the axis of rotation to determine a first vector corresponding to the front face of the forbidden volume;

aiming the boom in a second direction at a front, top left corner of the forbidden volume and determining a second vector corresponding to the second direction of the boom;

intersecting the second vector and the plane to define a first coordinate of the obstacle data;

aiming the boom in a third direction at a front, top right corner of the forbidden volume and determining a third vector corresponding to the third direction of the boom; and intersecting the third vector and the plane to define a second coordinate of the obstacle data.

9. The method of claim 8, wherein aiming the boom comprises at least one of aligning the boom using a video camera attached to the boom and aligning the boom using a laser pointer attached to the boom.

10. The method of claim 1, wherein limiting movement of the crane component comprises:

establishing the threshold distance as a slowdown threshold distance between the crane component and the forbidden volume; and changing a crane function responsive to the computed minimum distance between the crane component and the forbidden volume being less than the slowdown threshold distance.

11. The method of claim 10, wherein changing the crane function comprises slowing down the movement of the crane component in at least one direction that moves the crane component closer to the forbidden volume.

12. The method of claim 1, wherein limiting movement of the crane component further comprises:

establishing the threshold distance as a shutdown threshold distance between the crane component and the forbidden volume; and stopping the movement of the crane component in response to the computed minimum distance between the crane component and the forbidden volume being less than the shutdown threshold distance.

13. The method of claim 3, wherein the data representing the forbidden volume comprises a building information model, and saving obstacle data comprises aligning the building information model in the coordinate system.

14. The method of claim 4, wherein the forbidden volume is a prismatic shape and is formed based on the two coordinates.

15. The method of claim 1, wherein the boom is a luffing jib and the hook block is suspended from a free end of the luffing jib.

16. The method of claim 1, wherein the boom is a hammerhead jib and a trolley is coupled to and configured for movement along the hammerhead jib, wherein the hook block is suspended from and movable with the trolley.

17. A system for controlling a crane component of a tower crane in proximity of obstacles at a worksite, the tower crane comprising a mast, a rotating bed on the mast, a boom mounted on the rotating bed, and a hook block connected to the boom, the system comprising:

a crane control system configured to control operation of the crane component;

a processor in operable communication with the crane control system; and memory in operable communication with the processor, the memory storing data comprising:

data representing a coordinate system having an origin at a base of an axis of rotation of the rotating bed and fixed relative to the mast;

data representing the crane component;

data representing a forbidden volume; and computer executable instructions for execution by the processor, the computer executable instructions configured to calculate a minimum distance between the crane component and the forbidden volume based on the data representing the crane component and the data representing the forbidden volume, and to cause the crane control system to control movement of the crane component based on the calculated minimum distance, wherein the data representing the crane component includes hook block data represented by a hook block model in the coordinate system to model the hook block; and wherein controlling movement of the crane component includes controlling movement of the hook block to avoid the hook block entering the forbidden volume.

18. The system of claim 17, wherein the computer executable instructions are further configured to determine at least two coordinates of the forbidden volume.

19. The system of claim 18, wherein the boom is used to determine the at least two coordinates.

20. The system of claim 19, further comprising a boom aiming system for aiming the boom at the at least two coordinates of the forbidden volume.

21. The system of claim 20, wherein the boom aiming system comprises a system selected from the group consisting of a laser pointer and a video camera system.

22. The system of claim 18, wherein the hook block is used to determine the at least two coordinates of the forbidden volume.

23. The system of claim 17, wherein the crane control system limits the motion of the crane component in response the calculated minimum distance being less than a threshold distance, wherein the data further comprises:

a threshold distance value.

24. The system of claim 23, wherein the crane control system stops the motion of the crane component in response to the calculated minimum distance being less than a shutdown threshold distance, wherein the data further comprises:

a shutdown threshold distance value.

25. The system of claim 17, wherein the data representing the forbidden volume comprises a building information model, and wherein the computer executable instructions are further configured to establish the location of the forbidden volume within the coordinate system using one or more of the boom and the hook block.

* * * * *